US007494122B2

(12) United States Patent
Spinetti

(10) Patent No.: US 7,494,122 B2
(45) Date of Patent: Feb. 24, 2009

(54) DEVICE AND METHOD FOR STORING AND/OR DISPENSING RIGID OR FLEXIBLE SUBSTANTIALLY PLANAR ITEMS

(76) Inventor: Alberto Spinetti, Via Viconago, 50, Cadegliano Viconago (VA) (IT) I-21031

( * ) Notice: Subject to any disclaimer, the term of this patent is extended or adjusted under 35 U.S.C. 154(b) by 269 days.

(21) Appl. No.: 10/542,070

(22) PCT Filed: Jan. 14, 2004

(86) PCT No.: PCT/IB2004/000073

§ 371 (c)(1),
(2), (4) Date: Aug. 29, 2005

(87) PCT Pub. No.: WO2004/063065

PCT Pub. Date: Jul. 29, 2004

(65) Prior Publication Data

US 2006/0097444 A1 May 11, 2006

(30) Foreign Application Priority Data

Jan. 14, 2003 (IT) ..... MI03A0039

(51) Int. Cl.
*B65H 29/66* (2006.01)

(52) U.S. Cl. ..... 271/216; 242/324.2; 242/325; 242/437.4; 242/528; 242/613.3

(58) Field of Classification Search ..... 271/216; 242/324.2, 324.1, 325, 437, 437.4, 528, 613.3, 242/905
See application file for complete search history.

(56) References Cited

U.S. PATENT DOCUMENTS 3,471,098 A * 10/1969 Jannett ..... 242/411
4,337,864 A 7/1982 McLean
4,496,142 A 1/1985 Iwasaki
4,585,144 A 4/1986 Granzow
5,312,064 A 5/1994 Uesugi et al.
5,533,627 A 7/1996 Nordqvist
5,680,935 A 10/1997 Mistander et al.
2002/0113160 A1 8/2002 Niioka et al.

(Continued)

FOREIGN PATENT DOCUMENTS

DE 198 58 350 A1 6/2000

(Continued)

OTHER PUBLICATIONS

International Search Report of PCT/IB2004/000073, mailed Sep. 29, 2004.

(Continued)

*Primary Examiner*—David H Bollinger
(74) *Attorney, Agent, or Firm*—Nixon & Vanderhye P.C.

(57) ABSTRACT

Described herein are a device and a method for storing and/or dispensing plane, rigid, or flexible items, such as banknotes, cards or the like. The items are stored sequentially between successive windings of ribbon means which are wound and unwound between a supporting element, driven in rotation by at least one electric motor, and at least one take-up member. The supporting element has a non-circular cross section for obtaining one or more distinct resting surfaces on which the ribbon means are wound.

59 Claims, 21 Drawing Sheets

U.S. PATENT DOCUMENTS

| | | | |
|---|---|---|---|
| 2003/0000957 | A1 | 1/2003 | Brexel et al. |

FOREIGN PATENT DOCUMENTS

| | | | |
|---|---|---|---|
| EP | 0 151 808 | A2 | 8/1985 |
| EP | WO 03/030107 | A | 4/2003 |
| FR | 1 109 055 | A | 1/1956 |
| FR | 2 637 881 | A | 4/1990 |
| JP | 59-69332 | | 4/1984 |
| JP | 59-069332 | A | 4/1984 |
| JP | 01/76002 | A1 | 10/2001 |

OTHER PUBLICATIONS

Patent Abstracts of Japan, vol. 0081, No. 77 (M-317) Aug. 15, 1984.

* cited by examiner

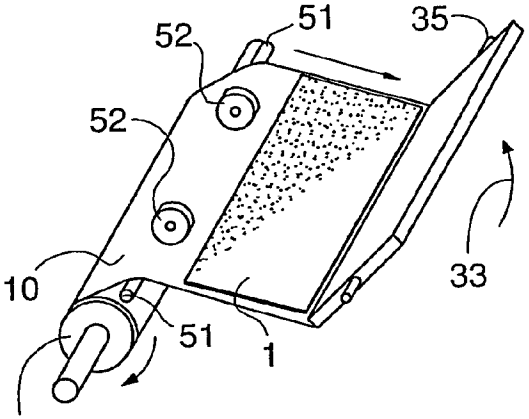
Fig. 4C
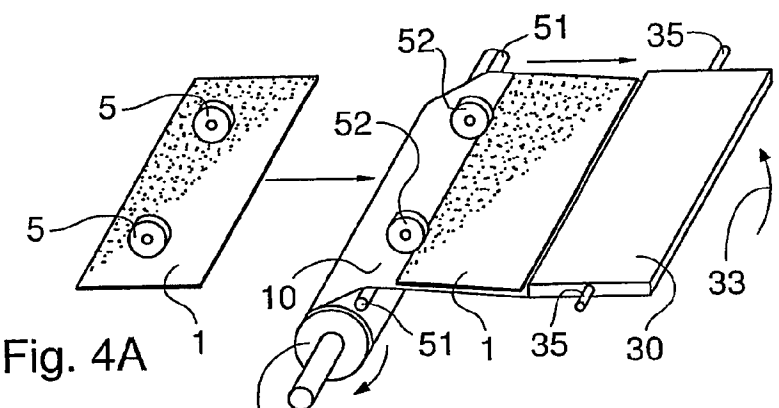
Fig. 4B
Fig. 4A
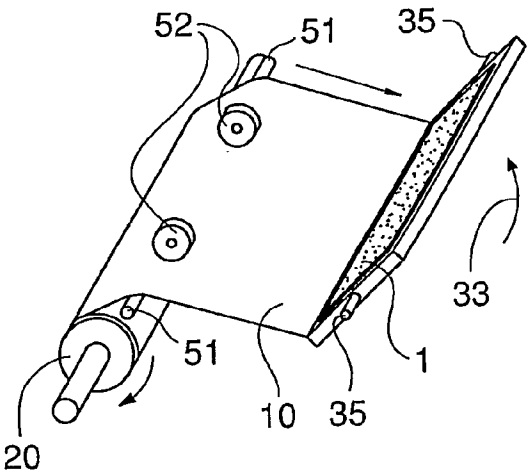
Fig. 5C
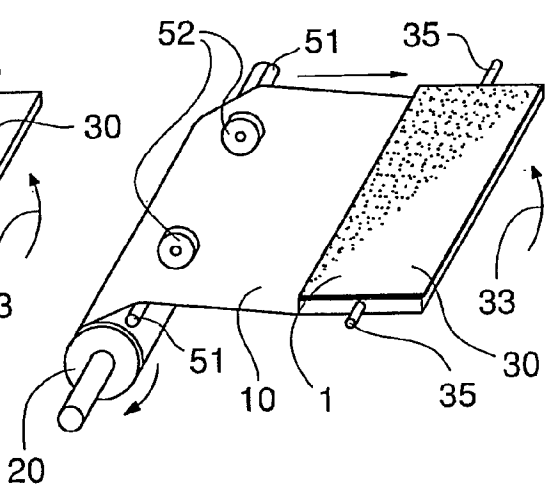
Fig. 5B
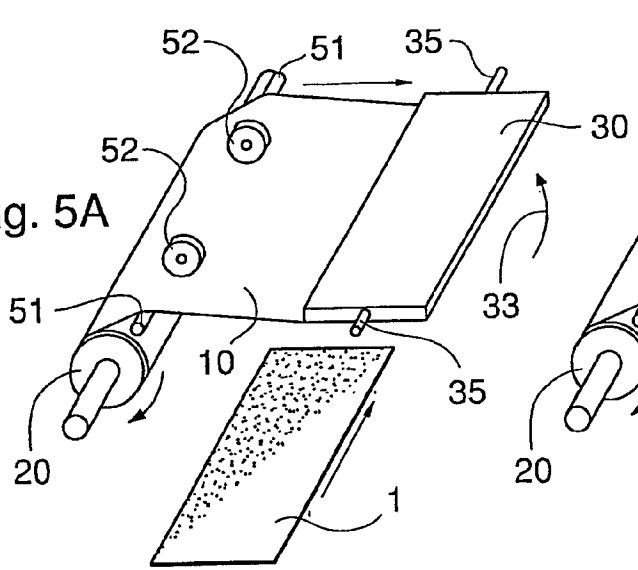
Fig. 5A

DEVICE AND METHOD FOR STORING AND/OR DISPENSING RIGID OR FLEXIBLE SUBSTANTIALLY PLANAR ITEMS

This application is the U.S. national phase of international application PCT/IB2004/000073, filed 14 Jan. 2004, which designated the U.S. and claims priority of IT MI2003A000039, dated 14 Jan. 2003, the entire contents of each of which are hereby incorporated by reference.

FIELD OF THE INVENTION

The present invention relates to a device and a method for storing and/or dispensing planar, rigid or flexible items in the form of sheets, foils whether entire or folded, and in any case items of this sort that may also be enclosed in envelopes.

In the definition adopted herein, the term "planar items" is meant to indicate for example banknotes, wads of banknotes, cards or, in any case instruments of credit or similar documents that take on this form, regardless of their state of wear.

BACKGROUND OF THE INVENTION

A device according to the present invention finds, for example, application in automatic machines for dispensing banknotes, for instance in automatic machines for self-service points, such as the so-called automatic teller machines (ATMs or machines of the Bankmatic type), as well as in machines installed at bank windows or cash-desks for payment at points of sale. The latter are used prevalently as systems of money protection, as an aid to cashiers, such as for example the so-called teller cash dispensers (TCDs).

In these machines, the money to be dispensed to the customers is introduced, generally when the machine is not in use, via the insertion of magazines constituted by boxes, each containing an orderly stack of banknotes of the same denomination and generally in an excellent state of conservation. Said boxes are provided with openings, which are closed during their transportation, but which are opened when introduced into ATMs and/or TCDs, said openings enabling mechanisms for singling out the banknotes (referred to herein also as "singling devices") present in the machines themselves to pick up, by friction or by suction, one banknote at a time from each individual box until the amount requested is reached (said singling devices require the banknotes to be in an excellent state of conservation).

In the past, in ATMs and TCDs, these types of machines adopted exclusively, and even today still widely adopt, said mechanisms. However, these devices may at times cause two or more banknotes to be picked up at a time (the so-called "double errors" or "chain-effect errors"). Said devices require therefore a system that will enable "rejection" of sums dispensed, the exact amount of which is in doubt, recovering the banknotes taken from a purposely provided drawer, referred to as "rejection drawer", and repetition of the singling-out process until the exact amount is certainly dispensed. These machines do not enable the money possibly deposited by the customers to be used for subsequent dispensing operations. For these and other reasons, their use tends to be less and less widespread in the art.

In addition to the above machines, a device according to the invention finds application also in machines that can perform both the functions of deposit and those of dispensing of banknotes, such as, for instance, the so-called recycling teller assistants (RTAs). Currently, machines of this type are almost exclusively installed in points manned by operators (bank and/or post-office windows, cash-desks in supermarkets, etc.), but attempts are in progress for extending the same principles also to self-service machines capable of accepting deposits, with automatic functions of counting and verification of the genuineness of the banknotes inserted.

In known machines, above all in the more recent ones, the banknotes are stored in ribbon-type devices, in which the ribbons are constituted by thin, sturdy and flexible films that are wound and unwound on cylindrical rollers.

There are known devices equipped basically with two films and three cylindrical rollers, in which one roller constitutes the supporting roller, or storage roller, to which are fixed the extreme ends of the two films and around which the banknotes are wound enclosed between the two films. To each of the other two rollers, which constitute the supply reels or take-up reels for recovering the film, there is, instead, fixed the other extreme end of each of the films, and an appropriate amount of film is pre-wound thereon.

The supporting roller or storage roller, which is appropriately driven by a specially designed motor, rotates and draws towards itself the films wound on the take-up reels, which usually exert a slight braking action in order to give the right tensioning on the film and hence achieve the right compactness of the film-banknote-film structure. Normally, the two films (one on top of and one underneath the banknote, which is enclosed between them) are identical as regards quality, type and thickness.

The banknotes are inserted individually in sequence between the two films by winding the two films on the storage roller, whilst extraction of the banknotes is performed by unrolling the two films from the storage roller and rewinding them on each of the corresponding reels.

In other words, at the moment of deposit of the banknotes, the storage roller rotates in the direction of winding, draws towards itself the ribbons or films contained in the two supply rollers, and winds, together with the ribbons, also the banknotes that are enclosed therein, thus storing them in sequence around the supporting roller. At the moment of dispensing, the rollers with the supply of film rotate so as to rewind the film, and the storage roller consequently reverses its direction of rotation, thus bringing about extraction of the banknotes contained between the two films and consequent dispensing thereof. Likewise known are storage devices that use just one film and, consequently, just one take-up roller in addition to the roller for supporting the banknotes. The banknotes are conveyed and guided at input to and at output from the supporting roller by means of wheels or other mechanisms that must be adherent to the roll constituted by films plus banknotes. However, the diameter of the winding roller increases during introduction of the banknotes and decreases during dispensing, and consequently said guide mechanisms must be mobile in order to remain adherent to the storage roller whatever the latter's diameter. For this reason, for the purpose of simplifying the mechanisms, it is usually preferred to use the already cited two-film devices.

Some examples of these known devices and of machines that use them are described in the U.S. Pat. Nos. 5,680,935, 5,533,627 and 4,337,864. These machines are generally equipped with one film-roller module for each denomination of banknote treated. The banknotes deposited are counted and checked and sent to the respective rollers according to their denomination.

The diameters of the rollers associated to each of the devices referred to above are different from one machine to another and depend not only upon the spaces available but also upon the maximum number of banknotes that it is intended to store and consequently upon the length of the film. The trend is in any case that of starting with relatively small winding reels in order to provide for greater space and consequently to enable storage of a larger number of banknotes. There are other parameters that determine the choice of the aforesaid diameters, such as the characteristics of the motors used for driving the rollers, the systems used for governing and regulating the speed, the power and control systems of the motors, the working conditions to which the devices are expected to be subjected, etc.

The above known film-roller devices, albeit solving the problems linked to the use of singling modules that were adopted in the past, present, however, a certain number of drawbacks. In the first place, they can be used for storing banknotes, or in any case exclusively items that are flexible and of contained thickness.

Furthermore, the banknotes remain wound for periods of time that are even relatively long before being dispensed and thus tend to assume a curvature which, in addition to being far from appreciated, is a cause of problems that arise at the moment of their dispensing. The curvature that a banknote assumes obviously depends upon the diameter that the supporting roller has at the moment in which the banknote is wound around it. The first banknotes stored around the supporting roller assume practically a curvature that is very close to that of the roller itself and will probably remain in said condition for a period of time longer than that of the ones which will be stored subsequently, according to the so-called "last-in, first-out" (LIFO) system.

The above fact causes a deterioration in the quality of the banknotes stored close to the roller, and thus said banknotes will present the biggest problems at the moment of dispensing. In some cases, an attempt is made to compensate for the curvature of the banknotes by subjecting the banknotes being dispensed to a process of curvature in a direction opposite to that of winding, for the purpose of recovering a certain degree of flatness. This treatment constitutes a stress that wears out the paper of which the banknote is made, so abbreviating its life. The curvature of the banknotes constitutes a big problem when a single-film device is used since the banknotes, in the dispensing step, tend to remain adherent to the roller itself, also as a result of a certain electrostatic charge that is caused when films made of plastic are used.

In fact, whether one-film or two-film systems are employed, the types of film to be used must be thin, resistant and flexible in order not to bring about an excessive increase in the winding diameter, which is already markedly affected by the thickness of the banknotes, and in order to withstand the multiple cycles of winding and unwinding. In general, a product such as Mylar is used or in any case polyesters, polycarbonates, or the like. These materials are easily charged with electrostatic energy as a result of sliding and consequently impose the need for particular care as regards the mechanisms, which not only must not favour the electrostatic charge but if anything have to attenuate it or, better still, neutralize it.

Also in the two-film systems, at the moment in which the films are drawn by the respective take-up reels, being unwound off the main roller, they are separated from one another around special fixed or rotating pins and, on account of the presence of electrostatic charge, there is never the absolute certainty that the banknote will not remain adherent to one of the two films. Consequently, it is frequently necessary for the banknote to be partially in direct contact with the fixed or rotating pins in the point of separation and divarication of the film in order to enable complete separation of the banknote itself from both of the films.

For this to be possible, it is necessary for the width of the films to be smaller than that of the banknote and for the films to wind the banknote itself more or less at the centre, consequently leaving its side parts exposed. The use of films that are narrower than the banknote leads, however, to another drawback. The corners of the wound banknotes, which are not enclosed between the films, remain exposed, and, when a banknote is inserted and said corners are in a given position, it may happen that the front side of the incoming banknote comes up against the corners of one of the banknotes already wound, thus stopping advance thereof. The banknote may then remain in a position set further back than it should be, with the risk that the next banknote will overlap or be superimposed thereon or, worse still, will get crumpled, so jamming the device completely.

The above phenomenon is accentuated by the fact that the exposed corners of the banknotes stored in the roller tend to lift up as a result of the tension of winding exerted by the films themselves, which act only at the centre of the roll. In order to overcome these drawbacks, there have been used, in some cases, two separate strips of film, set parallel and at a distance apart from one another, so as to cover the corners and to leave just the central part of the banknotes free from the film. This ensures that all the banknotes wound will not present dangerous protruding parts, since the side areas are pressed by the two films. The central part of the banknote, not covered by film, may consequently be used to favour detachment of the banknote from the films themselves in the dispensing stage. This solution almost always calls for the use of four distinct reels, each one driven by a motor of its own, or else the adoption of complex clutch systems.

However, it is highly unlikely that it will be necessary to use the same amount of film for each strip in order to wound a banknote, even though the two strips in question will be positioned on the same face of the banknote itself. Nor is it likely that the strips will require the same tensioning. In fact, it is highly unlikely that the banknotes being wound will be positioned precisely at the centre of the roller and precisely on top of the previous banknote. Staggering of this sort brings about a lack of homogeneity between the outer sides of the roller and its centre. This fact also entails different diameters between one strip and another, and this difference, even in the case of minimal variations, makes it necessary to handle each strip independently.

Other problems of known storage devices arise in the control of some variable parameters on which is it is necessary to intervene according to the conditions of winding and unwinding.

A first variable is represented by the different dimension of the diameters between the storage roller and the take-up rollers. In fact, the diameter of the storage roller increases to a greater extent than the diameters of the take-up reels decrease. With each banknote inserted, the diameter of the storage roller increases by a quantity equal to twice the sum of the thicknesses of each of the two films and of the banknote. On the other hand, the diameter of the take-up reels decreases by twice the thickness of just one film.

The power of the motor that drives the storage roller must be sufficiently high to guarantee the capacity thereof to unwind film from the respective take-up reels both at the start of the process and at the end.

Consider, for example that the storage roller will be empty in the initial working condition, and hence with a minimum diameter, whilst the take-up reels are full of film, which corresponds to their maximum diameter. Consequently, the motor of the storage roller will start to work in conditions of favourable torque (in terms of force and work), in so far as it must cause a roller of relatively small diameter to rotate and unwind film from the take-up reels that have relatively large diameters, given that all the film is still wound thereon.

As the machine proceeds to storage of the banknotes, the situation will undergo constant change to the disadvantage of the motor that pulls the storage roller, in so far as the latter's diameter increases rapidly as a result of the thickness of the two films and of the banknotes, whilst the diameter of the two reels of film decreases only in proportion to one layer of film. It should be borne in mind that normally the thickness of the films used is around 20-30 micron, whilst the thickness of a banknote is approximately 0.1 mm.

Usually, also for reasons of encumbrance, the take-up reels have an initial diameter smaller than that of the winding roller, and hence their diameter will decrease quite markedly. In fact, the length of a banknote corresponds frequently to a quantity of film that occupies more than one turn in the take-up reels. It follows that the situation of the torques of the motors worsens sensibly in the case of the storage roller, which will have to move an increasingly larger mass, as well as one of greater diameter, having at the same time to pull film coming from reels of increasingly smaller diameter.

In order to maintain the space of separation between one banknote and the next constant, or in any case to ensure that two or more successive banknotes will not pile up on top of one another (which would create considerable problems in the dispensing stage), it becomes necessary with each banknote deposited, both with the roller empty and with the roller full, for always the same amount (i.e., length) of film to be used. Consequently, the peripheral velocity of the storage roller and hence the speed of sliding of the film must be constant, and in any case controlled in all conditions, from the first banknote to the last. Maintaining the speed of sliding of the film constant also enables optimization of the quantity of film available in order to enable storage of the largest number of banknotes possible. Consequently, the angular velocity of the rollers must change constantly in order to achieve a constant peripheral velocity. Likewise, the ratio of the torques of the motors that control the winding roller and the reels of film must be controlled and adequate so as to guarantee the right tensioning of the film both with the roller empty and with the roller full. It is possible to understand the need to install sensors capable of detecting the tension of the films, the speed thereof, the entry or exit of each banknote, etc., as well as the need to use motors of adequate power and sophisticated electronic apparatus for controlling the motors and possible brakes.

It is, moreover, necessary to bear in mind that, in this sort of apparatus, the path of insertion of the banknotes in the storage roller corresponds necessarily to the path of their exit therefrom, in the dispensing stage, at least up to the point of separation of the films.

It is necessary for the last axis on which the pulling means are mounted, which, in the storage step, cause the banknote to advance in the direction of the storage roller and extract the banknote in the dispensing stage, to be at a distance from the roller itself less than the length of the banknote (i.e., of the side thereof parallel to the direction of insertion). In fact, the films are hardly ever provided with a sufficient grip to guarantee conveyance of the banknote at the desired speed right into the storage roller. Even a small deceleration of the banknote with respect to the film (i.e., slipping) could cause major drawbacks, such as, for instance, crumpling of a banknote or overlapping or superimposition of a number of banknote.

In the insertion step, a pulling axis could be used which is at a distance greater than the length of the banknote and which launches the banknote at a high speed so as to guarantee that a gripping point is reached inside the storage roller. However, in the dispensing stage, this technique is practically not implementable and it is hence necessary for the pulling axis to be set at such a distance as to enable extraction of the banknote from the film when the banknote is still partially pushed by the storage roller.

This need becomes a problem when the storage roller has been made to enable storage of a number of banknotes such that the difference between the initial diameter of the roller (roller empty) and the final diameter (roller completely full of banknotes) is so large as to prevent the pulling axis from possibly being set in a fixed position. In fact, by positioning the pulling axis so as to be able to extract the banknotes from the storage roller when the latter reaches its maximum diameter (roller full), the axis itself would be at too great a distance from the storage roller when this is empty. Consequently, the pulling axis would not be able to ensure the right thrust exerted on the first banknotes that are to be deposited within the roller itself, nor to ensure their complete extraction in the dispensing stage. This drawback is even more felt in devices that envisage insertion of the banknotes in the direction of their short side.

In addition to the above machines, a device according to the present invention finds application in equipment, such as timed safes used in a large number of branch banks and postal agencies, as well as in petrol stations and in general wherever there exists the need to deposit the excess of money to protect it from attempts at robbery or effraction and, at the same time, the need to supply money to operators (cashiers) when they have exhausted or reduced the supply present in the their cash-desks.

The machines so far used are substantially small safes equipped with a mouth designed to prevent the banknotes from being drawn out, through which the money in excess is introduced in wads, including non-homogeneous ones, causing it to drop by gravity into the safe. The safe is equipped with a door that can be opened only through the activation of a timer, which will enable its opening after a programmed-delay time has elapsed, which is usually long enough to discourage possible thieves from waiting so long. The duration of the delay is generally in proportion to the amount contained in the safe s This frequently results in a problem for operators who, when they require a supply of money for their own cash-desks, have to wait quite a long time, thus creating poor service. In order to find a partial solution to this drawback, machines have been built that are equipped with timed drawers or more usually machines equipped with a rotating drum, which is divided into various sectors (typically 22 sectors). The excess amounts are thus deposited through a single mouth with a mechanism for preventing notes from being drawn out, to which there is made to correspond an empty sector of the rotating drum.

The total amount present in the safe is thus divided into portions of an amount smaller than the total amount. In this way, when it becomes necessary to withdraw money, the operator will choose to access just one of the sectors, or else more than one sector in succession. Since the delay time is proportional to the sum present in the sector selected, it will be relatively short. This is basically a method that enables partialization of the deposits and the subsequent withdrawals in order to prevent the risk of the entire contents of the machine being removed in the withdrawal step.

The limit of these machines is represented by the fact that, since it is not possible for said systems to have excessive dimensions for reasons of space and functionality, the possible partialization is always insufficient. Note that in such machines it is frequently necessary to insert sums that may altogether amount to or even exceed 250,000 Euro, so that even if they have as many as 22 available sectors, to each of these there will correspond partial amounts that are in any case sizeable; hence, the delay times required for dispensing cannot of course be short.

In addition to the machines designed for handling banknotes, there are also known machines that perform functions of depositing and dispensing cards, such as for example telephone cards for the public telephone system, cards for recharging cellphones, pre-paid cards for motorway tolls, ski-pass subscriptions, printed tickets of the scratch-off type for car parks, and the like.

In the last few years, the companies issuing such documents of credit have had to resort to inserting the cards in envelopes in order to prevent the staff responsible for distributing them from possibly fraudulently using, even only partially, the content thereof and then putting them back in the dispensing machines to the detriment of the purchasers. This has of course led to protests on the part of the purchasers, which in turn has over time created major problems for the companies themselves and a consequent lack of proper service.

The use of sealed envelopes, in which the cards are enclosed, enables the purchaser to verify immediately whether these have been tampered with. The presence of the envelope has, however, created an enormous problem to currently existing devices for automatic dispensing of said cards. In fact, all these devices operate through a mechanism which, by means of a pusher having a thickness that is slightly smaller than the thickness of the card, by advancing from a resting position, slides out the last card in a stack, passing it through a "gouge", which, since it has an opening of a size slightly greater than the thickness of the card enables extraction of the after, preventing the next to last card (which is located immediately above the one to be dispensed) from possibly being erroneously dispensed.

These machines are very widespread, but with the adoption of cards pre-inserted in envelopes they present many problems of operation since the envelope, in which there is frequently also inserted a small instruction leaflet (frequently folded a number of times), lacks rigidity and no longer has a homogeneous thickness; consequently, the action of the pusher and that of the output gauge no longer have the same degree of effectiveness. Furthermore, in the case of other similar items which are generally not inserted in envelopes (e.g., cards for car parks), the introduction on the card of panels of the scratch-off type renders this technique even less reliable in so far as the rubbing between one card and another in the step of extraction could remove in part the removable panel, with the consequent possibility of uncovering the underlying information.

So far no real solution to the above problem exists, so that such cards are frequently distributed using traditional vending machines of the type used for self-service sale of packets of cigarettes or the like. This means that the firms responsible for running these machines have to insert each card manually in a cardboard box or the like, of considerable dimensions (the mechanisms of said machines operate properly with containers having a thickness of not less than one centimetre). Each box is positioned in the magazine of the vending machine once again manually.

One of the biggest drawbacks, in addition to the procedure and to the cost of boxing of each card, is due to the low capacity of these machines. It is to be considered that a telephone card has a thickness, without the envelope, of 0.4 mm and, with the envelope, 0.8 mm approximately. Whilst machines of the pusher type could be equipped with a magazine of a few hundred cards, a column of a vending machine contains at the most (as a result of the presence of box) around 40 pieces. To reach the hundreds of pieces in the magazines it would be necessary to build vending machines of dimensions that are unthinkable or else sacrifice all the columns of the vending machine only for the sale of cards.

There are moreover known machines for currency exchange or machines for changing coins into banknotes and vice versa, for example machines that can perform both the function of depositing and that of dispensing banknotes, coins, etc. By way of example, consider classic self-service currency-exchange machines, which, although they are today a little less widespread in Europe on account of the advent of the Euro, nevertheless remain indispensable, or else a self-service fuel pump or the like. These machines need to have available a device called "Escrow" or "Repentance Escrow".

To explain the functions of such a device, assume, for example, that a customer intends to change money or to purchase fuel or another product. The customer inserts a certain number of banknotes into the machine to reach an amount corresponding to the price of what he wishes to buy. We shall assume that the first banknotes introduced are accepted by the machine and that at a certain point in the transaction the customer introduces a banknote that is rejected (because it is false or doubtful or in a poor state of conservation, etc.). If the customer does not have available other banknotes that enable him to conclude the transaction he must have the possibility of aborting the purchase and returning into possession of the money that he has already introduced into the machine.

It should be emphasized that the banknotes that the machine should return must necessarily be the ones introduced by the customer. The function of the "Escrow" device is thus that of withholding in a sort of "park" the banknotes introduced up to completion of the transaction and returning them to the customer whenever it is not possible to complete the transaction.

Escrow devices so far proposed are all more or less complicated and costly in so far as they must be adapted to, and inserted between, pieces of equipment that are frequently very different from one another according to the manufacturer, the quality, and the technologies used. For instance, these devices are generally installed between the output mouth of the reader of banknotes (aimed at recognition and validation of the banknotes introduced) and the input mouth of the box or bag for depositing. In fact, the banknotes introduced are stored in purposely provided hermetically closeable boxes or bags, which will then be removed by the competent staff and replaced with empty containers.

Consequently, the escrow device must "park" one or more banknotes, holding on to them until the end of the transaction and then, provided that the latter goes through successfully, finally send them into the box or bag. In the event of a transaction that does not go through successfully, the banknotes must be returned to the customer. The fact that the banknotes parked may be one, or more than one, complicates the structure of the escrow device, which must handle correctly both an individual banknote and a wad of banknotes not properly ordered. Finally, it is emphasized that these mechanisms can rarely handle wads of more than 5 to 10 banknotes.

Likewise known are machines that enable insertion and withdrawal of identity cards or similar documents that are not yet personalized. It may occur, in fact, that in public offices, in which a number of operators are authorized to fill in and personalize said documents (identity cards, passports, driving licences, and the like), non-personalized valid documents may get stolen. Even though said documents are kept in special safety cabinets, once the cabinet has been opened, it is difficult and somewhat troublesome to check that all the operators who have access thereto take out only the number of documents required.

SUMMARY OF THE INVENTION

The general object of the present invention is to propose a device and a method for storing and/or dispensing planar items in the form of sheets in general, whether rigid or flexible, such as for example banknotes, which will enable the drawbacks of known devices to be overcome.

A particular object of the present invention is to propose a device of the type referred to above which will be particularly versatile in its application so as to enable storage indifferently of individual items or sets of items, for example individual banknotes or wads of banknotes. Another particular object of the present invention is, to propose a device and a method of the type referred to above that will enable storage of planar items, for instance banknotes, without causing any deformation that might jeopardise proper dispensing thereof and wear of the paper of which they are made.

Another object of the present invention is to propose a device and a method of the type referred to above which will enable simplification of the steps of storage and dispensing of the items.

Yet another object of the present invention is to provide a device and a method of the type referred to above which will make it possible to know certainly the correspondence between the position of each item deposited and who or what has made that deposit, as well as when the deposit was made.

A further object of the present invention is to propose a device of the type referred to above which will enable simplification of control of the motor-powered system for driving the members set in motion for storage and dispensing the substantially planar items, irrespective of the amount of items contained at each instant in the device.

Yet another object of the present invention is to provide a device which will enable storage of a large number of items in a particularly limited space.

Yet a further object of the present invention is to provide a device and a method of the type referred to above which is able to prevent jamming of the items, for example banknotes, during the steps of storage and errors in the number of banknotes extracted during the dispensing steps.

Yet a further object of the present invention is to propose a device for storing and/or dispensing planar items which will present marked characteristics of modularity in order to facilitate setting-up and assembling of machines comprising a number of identical devices.

The above objects are achieved thanks to a device according to claim 1 and thanks to a method according to claim 30. Further characteristics are specified in the corresponding dependent claims. According to a first aspect of the present invention, a device is provided for storing and/or dispensing substantially planar items in the form of rigid or flexible sheets, comprising at least one supporting element driven in rotation by at least one electric motor and ribbon means wound on the supporting element and on at least one take-up member for taking up the ribbon means, the banknotes being stored sequentially between successive windings of the ribbon means, which are wound and unwound between the supporting element and at least one take-up member, the device being characterized in that the supporting element has a non-circular cross section for providing one or more distinct resting surfaces, on which the ribbon means are wound.

In practice, the cross section perpendicular to the axis of rotation is not circular, as occurs for known cylindrical rollers, but has one or more resting surfaces that may be convex, concave, or plane. Given the same degree of encumbrance in terms of diameter (with the roller full), with a cylindrical roller of a known type, the solution proposed by the present invention enables storage of a larger number of items, without causing any damage to them. For example, in the particular case where the items are represented by banknotes, these are each stored in a position corresponding to a resting surface and consequently do not undergo any deformation, as occurs, instead, in the case of known devices, in which cylindrical rollers are used; indeed, banknotes stored in the way proposed by the present invention in part recover their flatness.

According to the preferred embodiment, the supporting element is formed by a plate having a substantially rectangular shape, comprising at least two opposed plane resting surfaces. Alternatively, for example for flexible items such as banknotes, the resting surfaces may have a slightly concave or convex shape, with the advantage of improving maintenance of the position of each individual banknote on the winding surface and increasing the resting surface of the banknotes on the plate, given the same width of the latter, or, in other words, given the same diameter of the circle described by the plate during rotation.

The rectangular plate, which is set in rotation about its axis of symmetry, preferably has a larger side of dimensions that are equal to or greater than the larger dimension of the planar item in plan view and a smaller side of dimensions that are equal to or greater than the smaller dimension of the item in plan view, According to a possible embodiment of the present invention, the ribbon means comprise just one film, which is wound and unwound between the supporting element and a take-up member. The latter could be formed, for example, by a cylindrical roller as in known devices; it could in turn have a rectangular cross section like the supporting element, or else a polygonal cross section.

According to another possible embodiment, which is alternative to the previous one, the ribbon means comprise at least two distinct films, which are wound and unwound between the supporting element and at least two distinct take-up rollers (or even two supports with rectangular or polygonal cross section). The items are thus stored sequentially between the two films.

The film may be smooth or preferably have a rough, coarse, irregular or in any case non-smooth surface, such as may be, for example, an embossed film or else a surface on which there has been deposited, either uniformly or in non-uniform stretches, an extremely thin layer of material having particular gripping properties, such as, for instance, polyurethane or rubber resins, which are spread so as to adhere stably on the film.

With each turn of the supporting element, there are thus stored exactly two items on the two opposite resting surfaces of the plate (both with the support full and with the support empty). This renders the steps of storage and dispensing of the items particularly simple and reliable, preventing any slipping or overlapping of the items, which could jeopardise proper operation of the device. This highlights how much more secure and reliable is the dispensing of a precise number of items previously stored without the use of singling-out systems. Furthermore, a device according to the invention affords the considerable advantage of providing the possibility of knowing exactly the position in which each item has been deposited, and therefore the possibility of associating, with total certainty, an item deposited to the person who has made the deposit.

Another advantage of the above device is provided by the fact that it enables introduction therein and subsequent dispensing not only of individual documents or instruments of credit, such as one banknote at a time, but also wads of said instruments of credit. If, for example, the device is used to provide a timed safe, it is possible to introduce therein wads of banknotes made up of banknotes of the same denomination or of a different denomination for a given pre-defined amount. Each wad is deposited by being rested on one of the surfaces of the depositing surface and enclosed between two films. In addition to these advantages, it should be noted that the overall dimensions of the rotating supporting device does not vary excessively between the "full" condition and the "empty" condition, thus enabling storage of a large number of items.

Furthermore, the versatility of the device is increased as regards its installation in machines designed for storing and/or dispensing banknotes and more in general items such as instruments of credit and cards or the like. In fact, the insertion of the banknotes may even be carried out in a direction parallel to the axis of rotation of the supporting element.

In other words, in the particular case of banknotes, the banknotes themselves may be introduced either longitudinally or crosswise, either with modalities of manual insertion, one after the other, or automatically via the use of a commercial singling device, such as, for example, a desk banknote-counting device or by means of a device specifically built to perform this function. In known machines, where the supporting element is represented by a cylindrical roller, there exists in practice only the possibility of storing and dispensing the banknotes in a direction perpendicular to the axis of rotation of the cylindrical support, at least up to the point of separation of the banknotes from the film.

In the device according to the present invention there may advantageously be provided means for controlling traction of the films between the supporting element and the roller (or rollers) provided for taking up each film. Said control means may, for example, include a dandy-roller system, as well as one or more braking systems, which have a pre-set friction or can be operated upon command.

According to a second aspect of the present invention, there is also provided a method for storing and/or dispensing substantially planar items in the form of rigid or flexible sheets, in which the items are stored sequentially between successive windings of ribbon means, which are wound and unwound between a supporting element, driven in rotation by at least one electric motor, and at least one take-up member, said method being characterized in that the supporting element has a non-circular cross section in order to obtain one or more distinct resting surfaces, on which the ribbon means are wound. Some characteristics and advantages of the present invention are listed and summarized below:

- in the specific case of banknotes, the latter remain plane and hence do not present any curvature when they are dispensed and do not require application of subsequent stresses for recovery of flatness;
- instead, banknotes kept on a plane surface tend to recover a higher degree of flatness;
- the items may be inserted in the device either longitudinally or transversely;
- the number of items that can be stored is fixed for each revolution of the motor (two items per revolution) whatever the number of items already stored on the storage plane (or rotating plate) and whatever the size of the items themselves;
- the overall dimensions of the storage plane, or rather the diameter of the circle that this surface describes as it rotates, remains almost unaltered for the entire duration of the cycle (from empty to full) and in any case increases only by the thickness of the film or films even when a large number of items is inserted;
- the speed of advance of the film does not need to be constant and is not an important parameter. It is sufficient to synchronize rotation of the motor in such a way that each incoming item will correspond to half a turn of the storage plane;
- the exit path and the entry path may even not coincide;
- release of the items by the storage plane may occur even simply by gravity;
- the items coming off the "storage plane" are conveyed to an outlet opening accessible to the customer or operator;
- the device described affords the possibility of a wide variety of embodiments of machines of different types, such as ATMs, TCDs, RTAs, etc. by simply assembling appropriately (vertically, and/or horizontally, or in any other way) a certain number of said devices and connecting them to a single common conveyor;
- the device can also be used simply as an individual manual unit for depositing banknotes and for subsequent dispensing thereof. This could be particularly suitable for service points, such as cash-desks in supermarkets and shops, and cash windows in small branch banks or post-office agencies, etc.;
- the banknotes may be introduced into the device either manually or using singling devices. An example may be the connection of the present device to a commercial banknote-counting machine, by arranging the output of the latter to be connected to the input of the device;
- another possibility is to use just one singling device set in sequence in front of each individual storage device in order to render the apparatus fast and at the same time inexpensive as a whole;
- a singling device may also be installed for each device in a fixed and stable way. The "storage plane" may operate both with banknotes inserted longitudinally and with banknotes inserted transversely;
- for example, it is possible to use just one singling device, downstream of which there is installed a reader for checking whether the banknotes are genuine or false, after which the banknotes are diverted and sent on, via the common conveyor, to the corresponding device according to the denomination or type of the banknote (e.g., different currencies, etc.);
- in addition to the specific application in handling banknotes, the device can be used also for cheques and other types of items, for example, for withdrawing or issuing tickets, telephone cards, identity cards and documents that are still to be personalized, ski-passes, road maps, either folded or opened out, coins in envelopes, and in general any type of item whatsoever that may be rested on a plane surface, or else on a slightly concave or slightly convex surface.

BRIEF DESCRIPTION OF THE DRAWINGS

Further characteristics and advantages of the present invention will emerge more clearly from the ensuing description, with reference to the attached drawings, in which:

FIGS. 4A-4C are schematic illustrations, in perspective, of some steps of storage of a banknote according to the schemes already illustrated in FIGS. 2A-2F;

FIGS. 5A-5C are schematic illustrations, in perspective, of some steps of storage of a banknote that arrives along a path perpendicular to the direction of advance of the film in the device and that is deposited on the supporting element;

Figure 11:
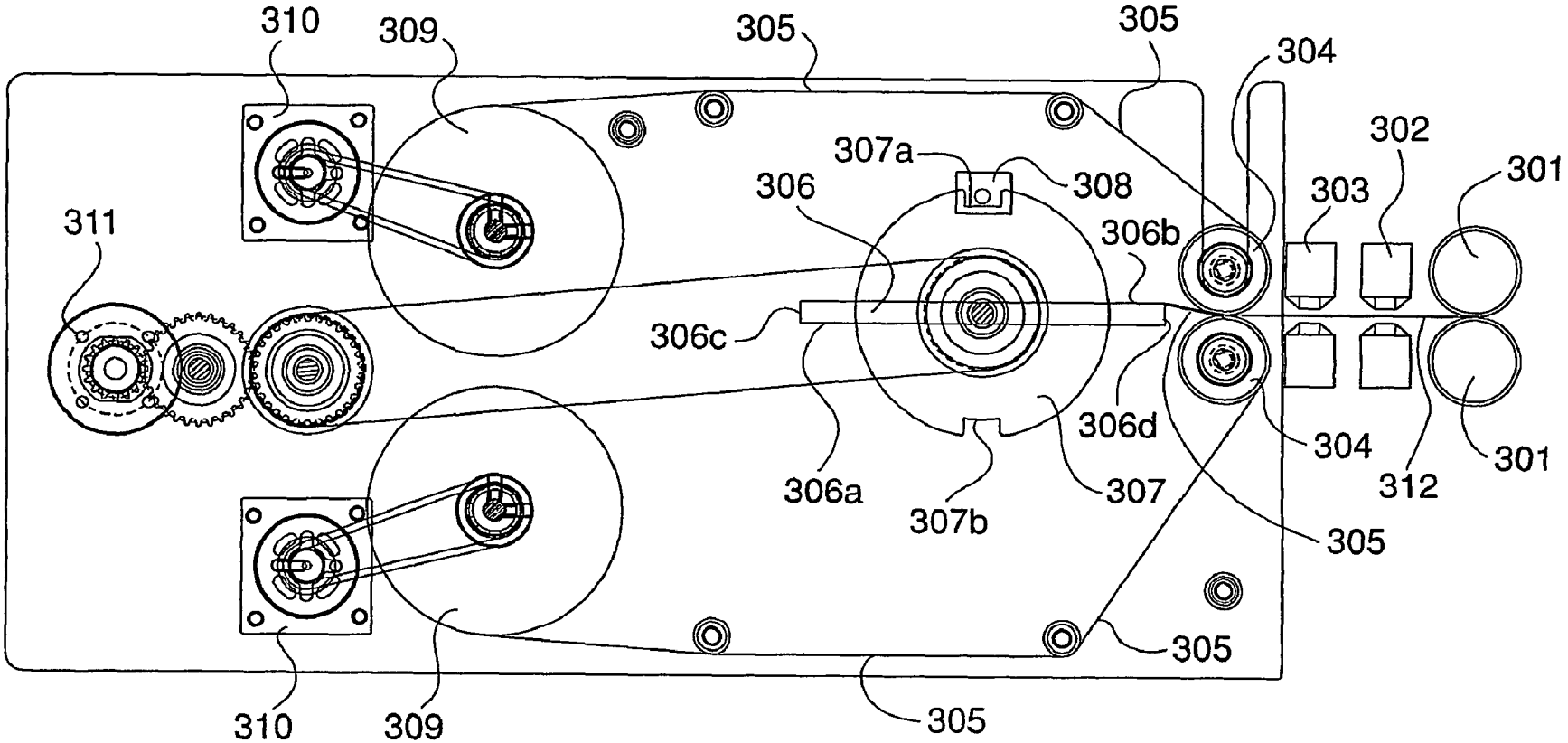
Figure 12A:
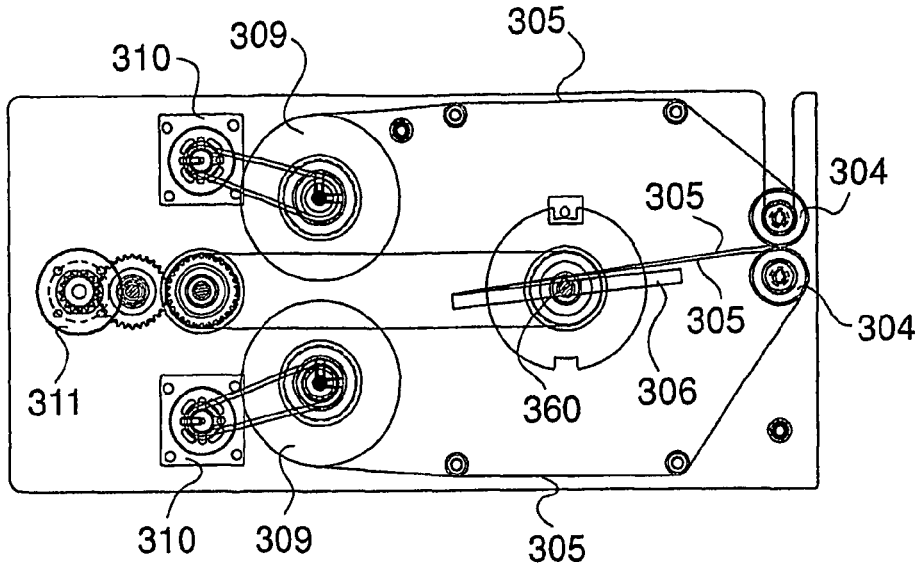
Figure 12B:
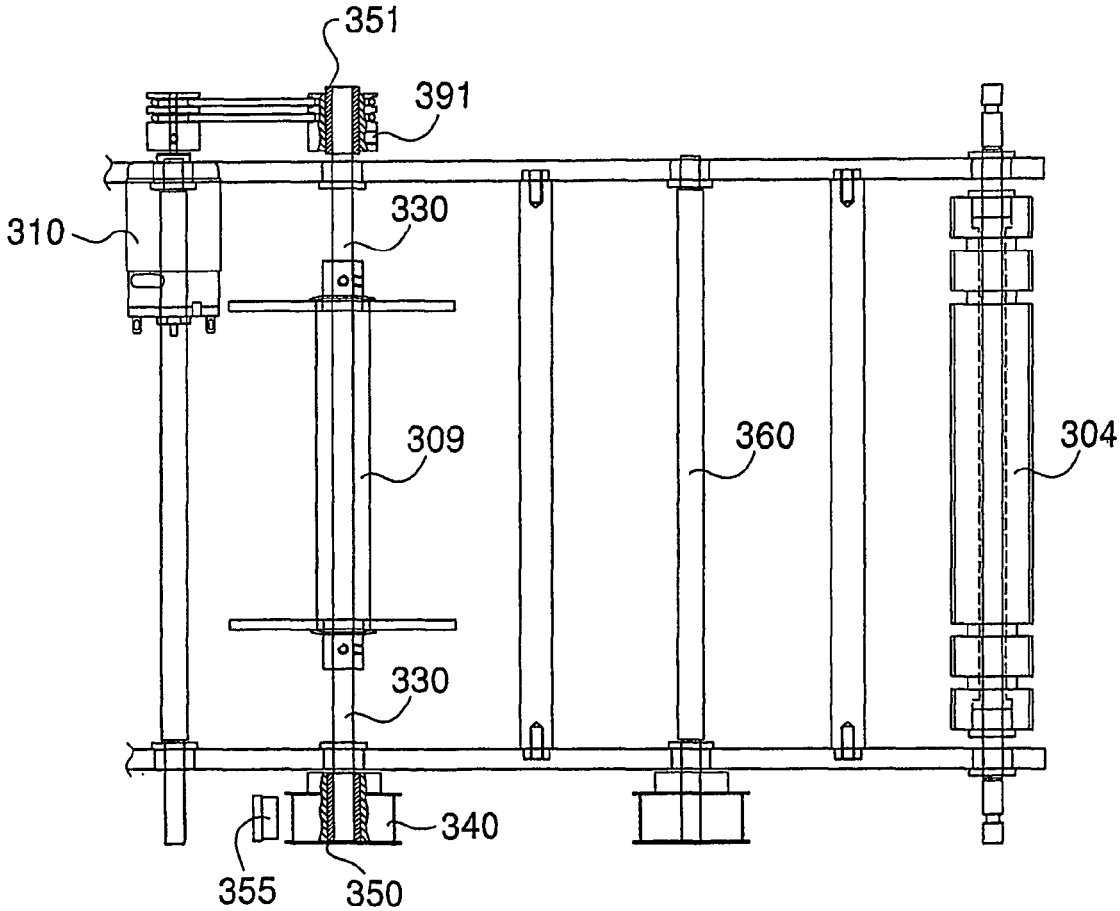
Figure 13A:
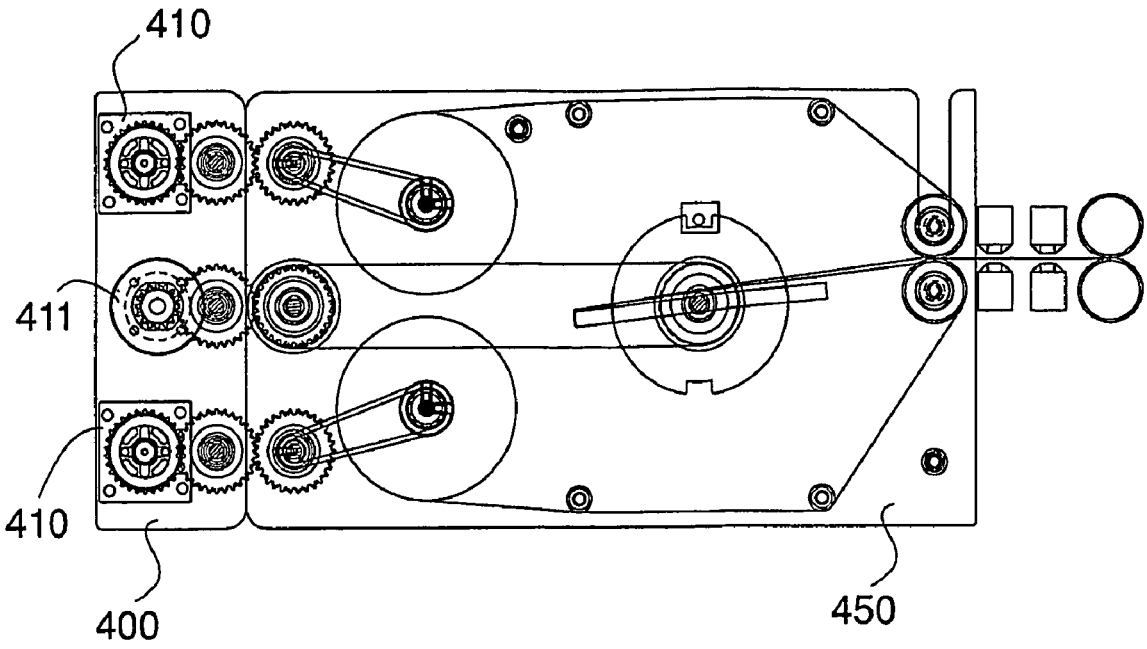
Figure 13B:
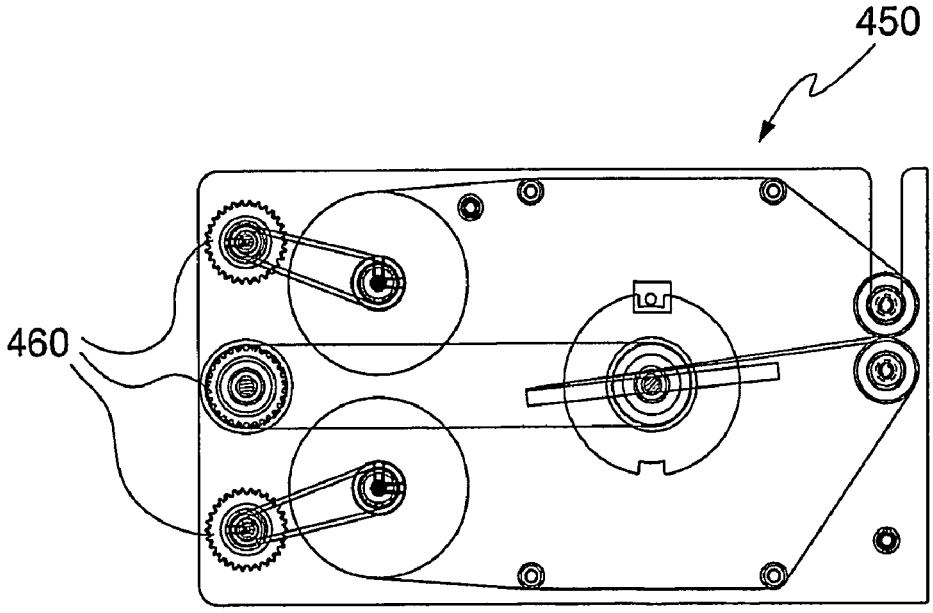
Figure 14A:
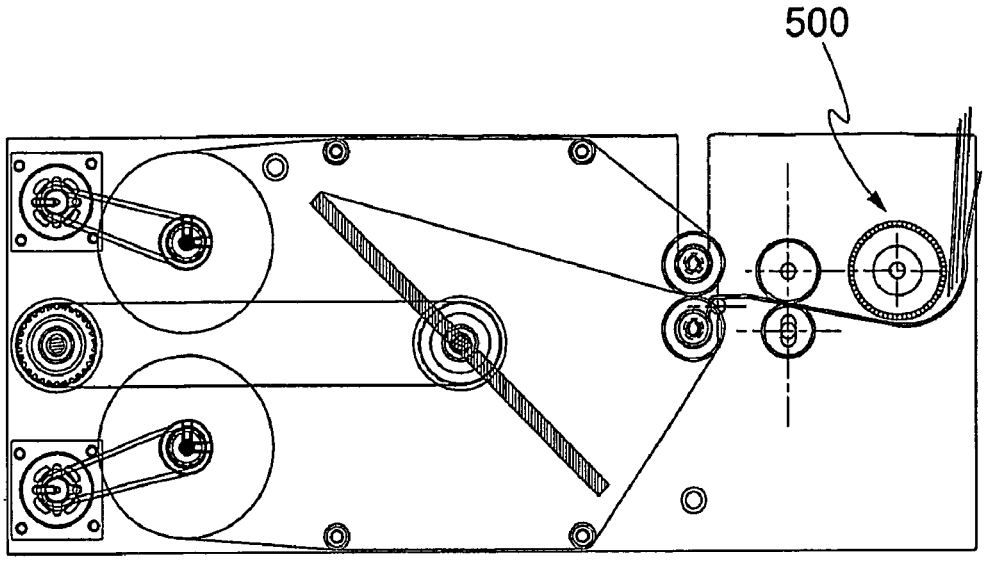
Figure 14B:
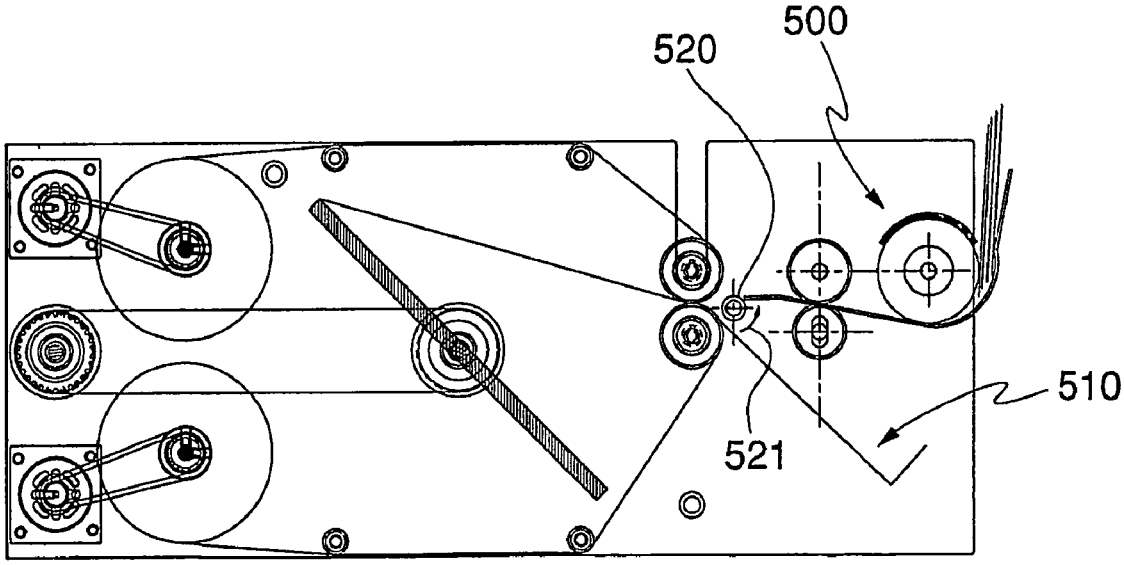
Figure 15A:
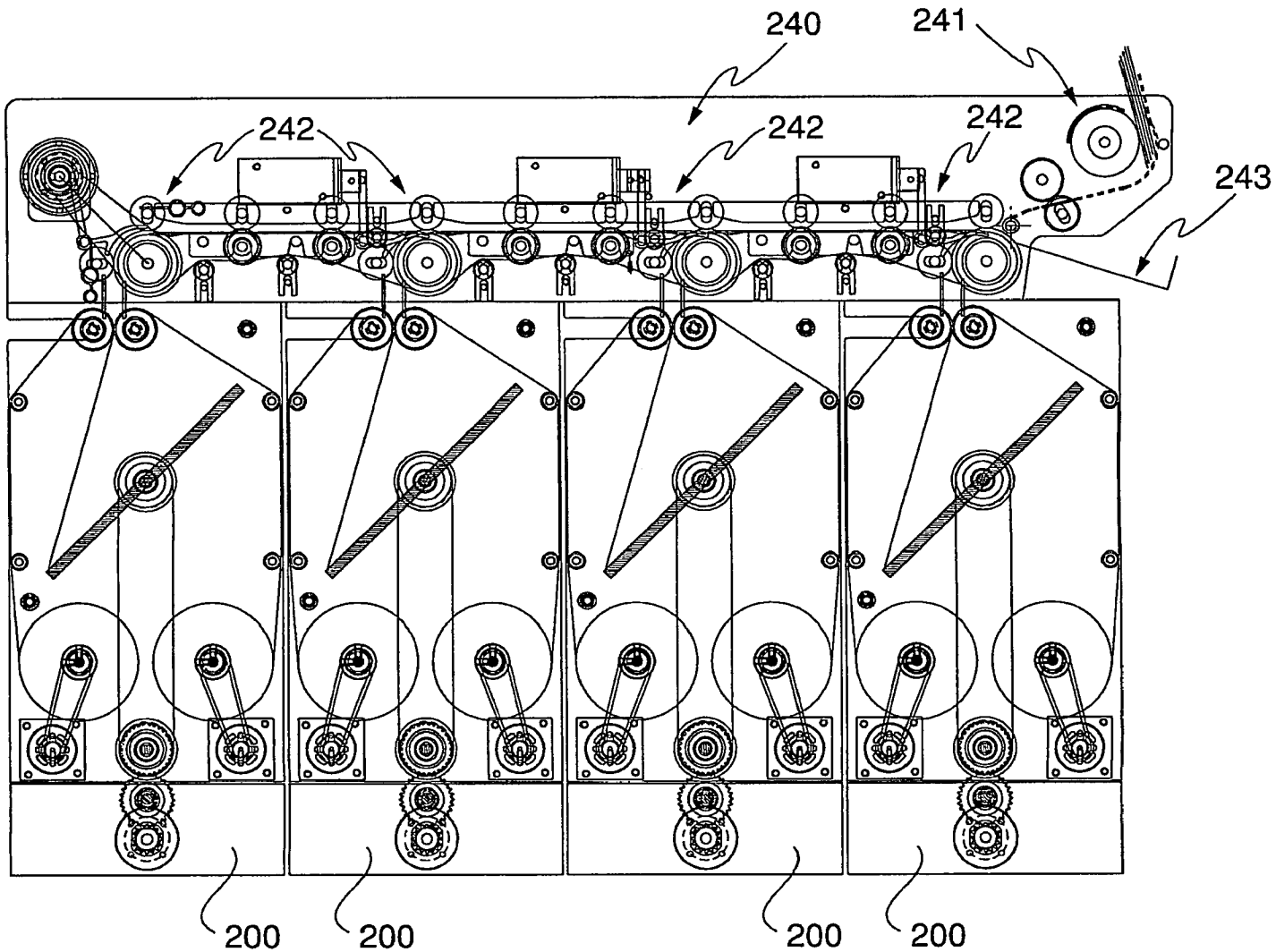
Figure 15B:
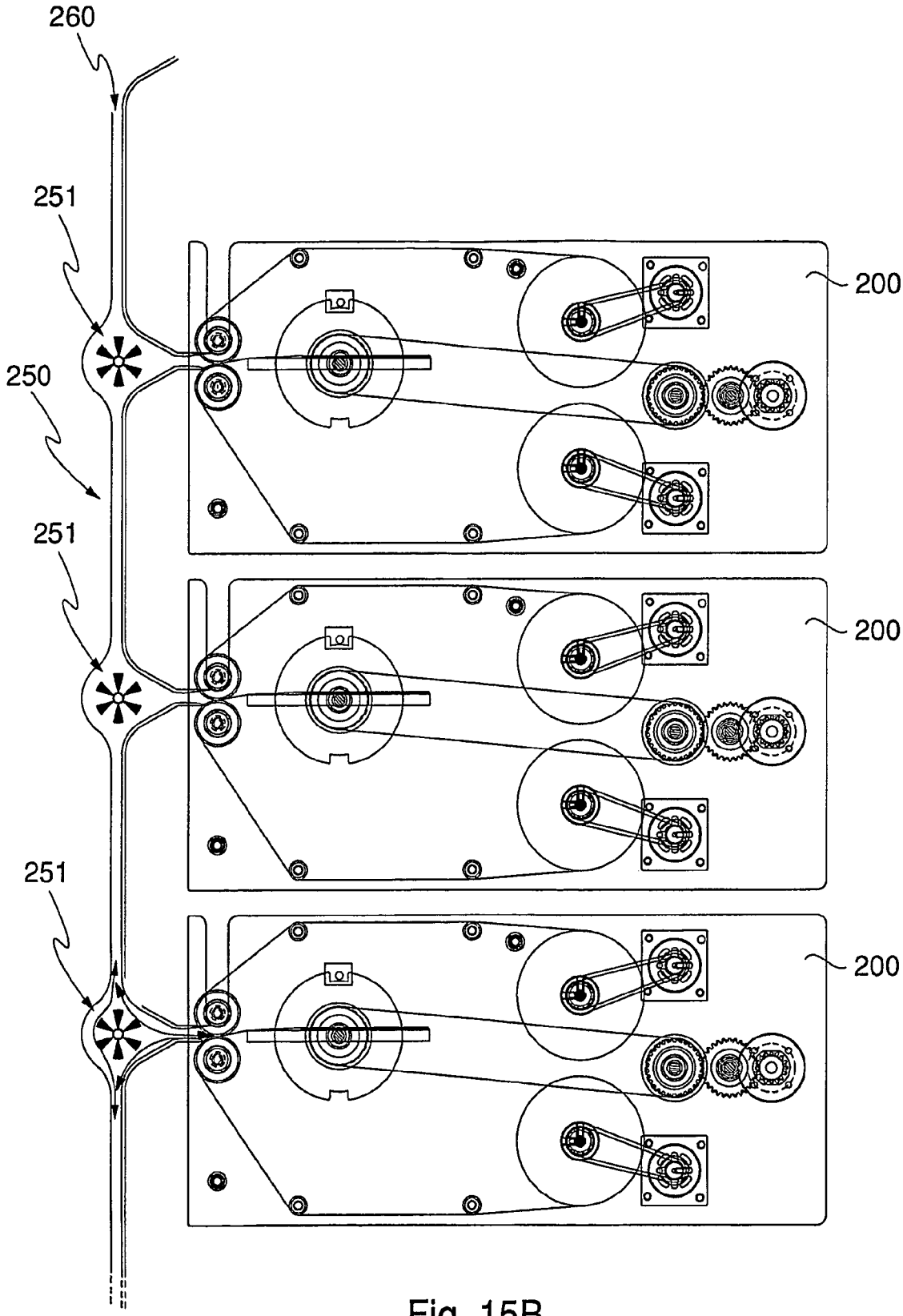
Figure 16:
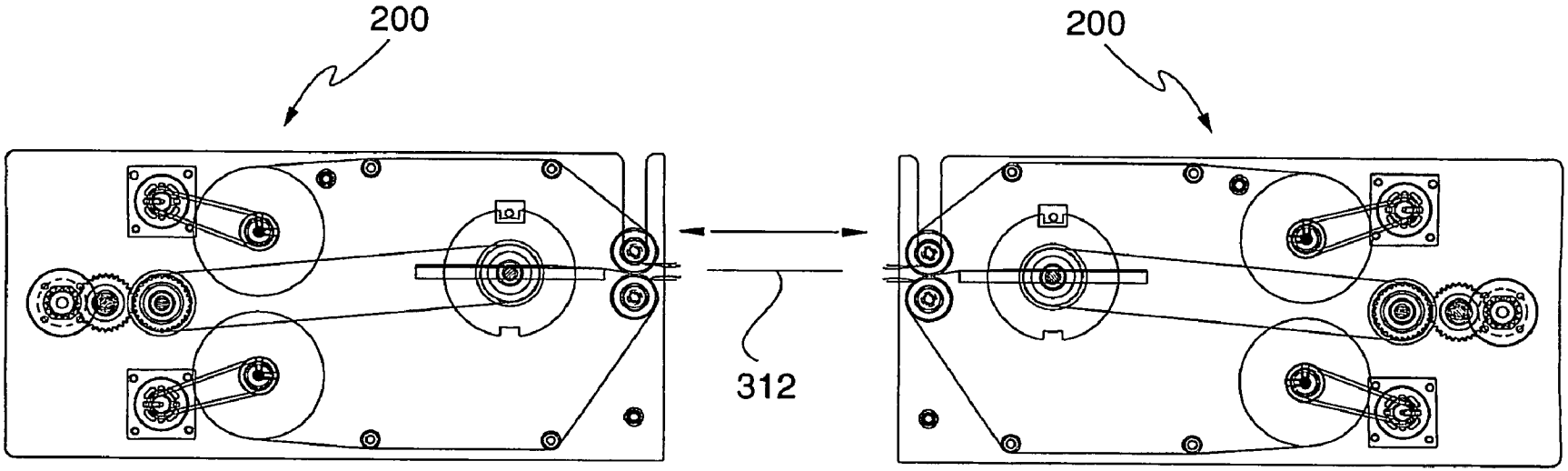
Figure 17B:
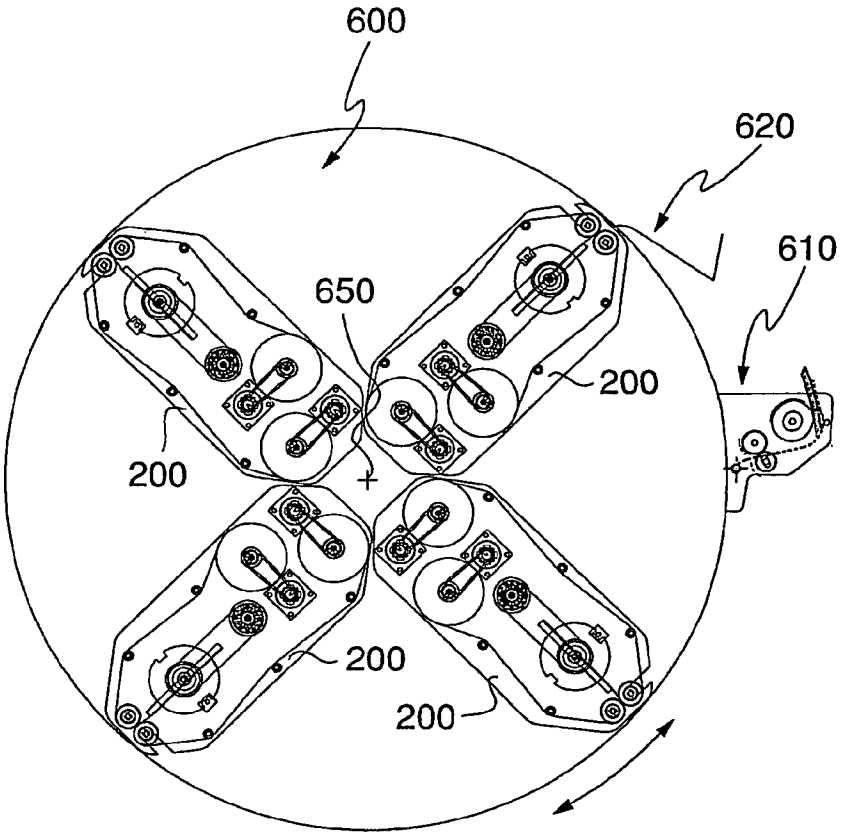
Figure 17A:
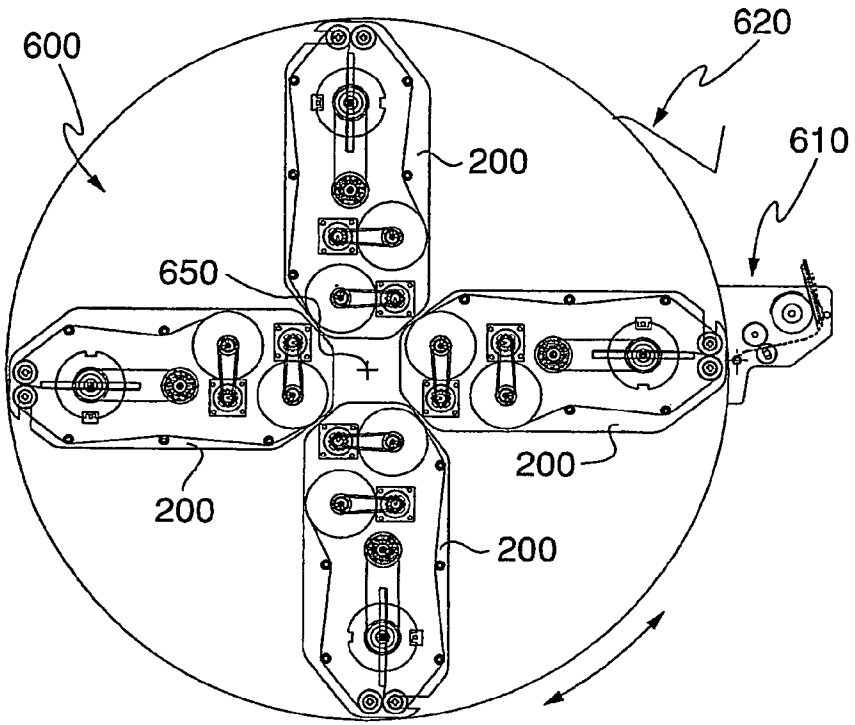
Figure 18A:
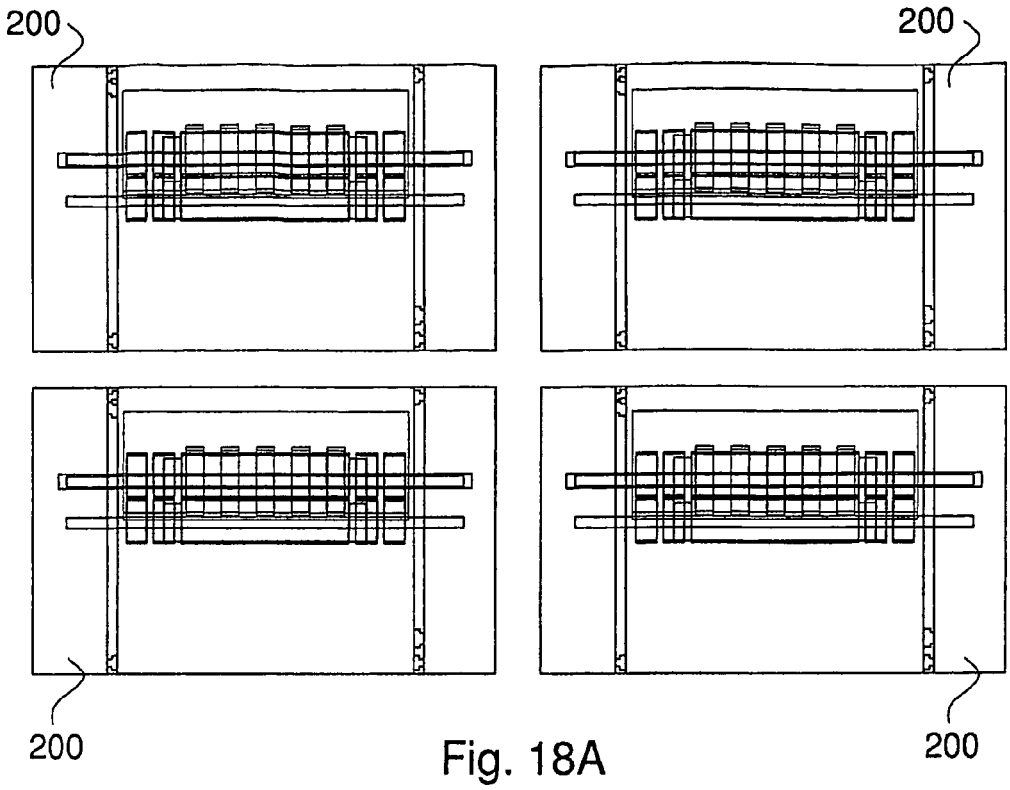
Figure 18B:
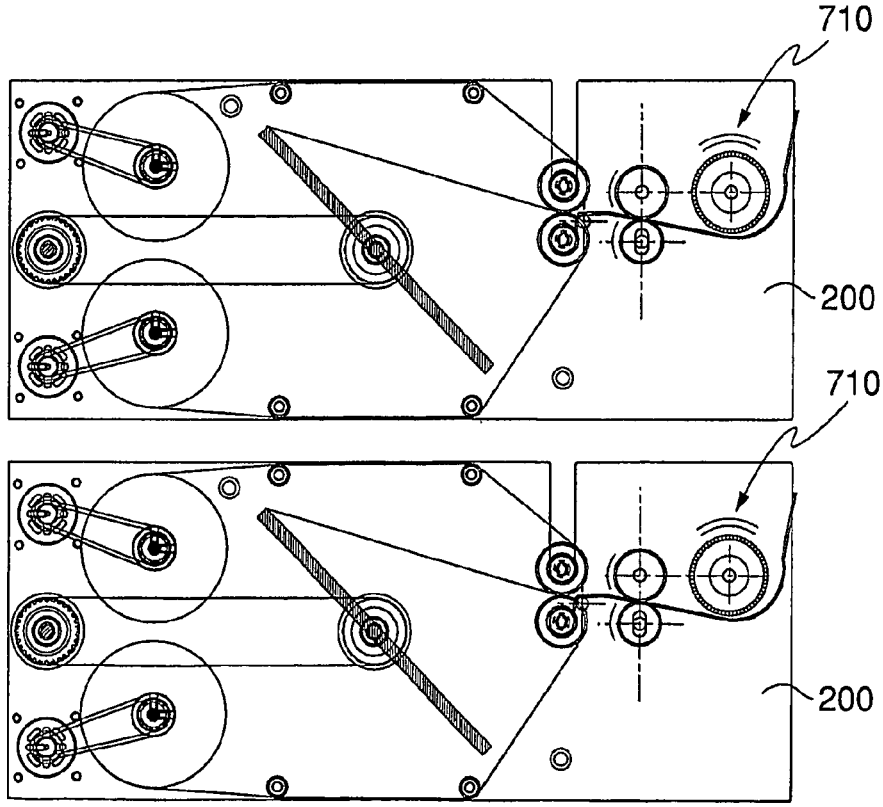

FIGS. from 10A to 10D illustrate the sequence of depositing a wad of banknotes by means of another embodiment of a device according to the invention;

FIG. 11 illustrates another two-film embodiment of a device according to the invention;

FIGS. 12A and 12B illustrate another possible embodiment of a device according to the present invention;

FIGS. 13A and 13B illustrate an embodiment of a device formed by two distinct portions that can be separated from one another;

FIGS. 14A and 14B illustrate two embodiments of a device according to the present invention, which moreover comprise a singling module;

FIG. 15A shows one of the possible configurations of devices according to the invention assembled in a machine of the cash-in/cash-out recycling type;

FIG. 15B is a schematic illustration of the horizontal arrangement of devices according to the present invention in a machine equipped with a conveyor 250 having a vertical development;

FIG. 16 illustrates a possible application obtained with the combination of a number of devices according to the present invention;

FIGS. 17A and 17B illustrate a machine with a particular arrangement of the devices according to the present invention; and FIGS. 18A and 18B show a machine with a configuration of four devices arranged in two rows and two columns.

MODES FOR CARRYING OUT THE INVENTION

In the ensuing description there are illustrated, by way of example, a number of embodiments of the invention, with particular reference to the storage and/or dispensing of banknotes. However, it is understood that the same principles of the present invention may be applied to all types of substantially plane, rigid or flexible, items already referred to previously or which will possibly be specified hereinafter.

Figure 1A:
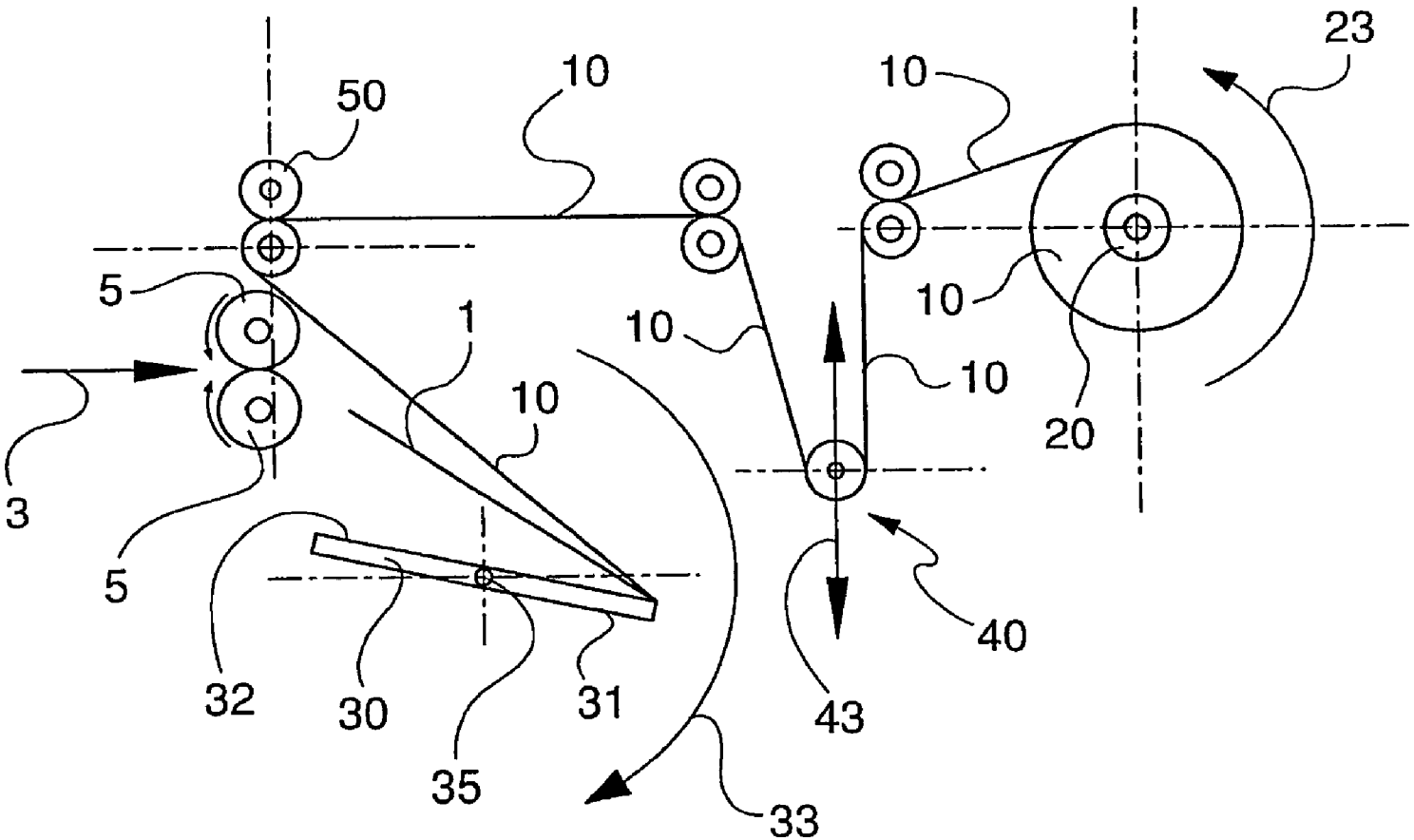
FIGS. 1A and 1B are schematic illustrations of a device for storing and/or dispensing banknotes according to a possible embodiment of the present invention, with the storage element shown respectively in the empty condition and in the full condition.
Figure 1B:
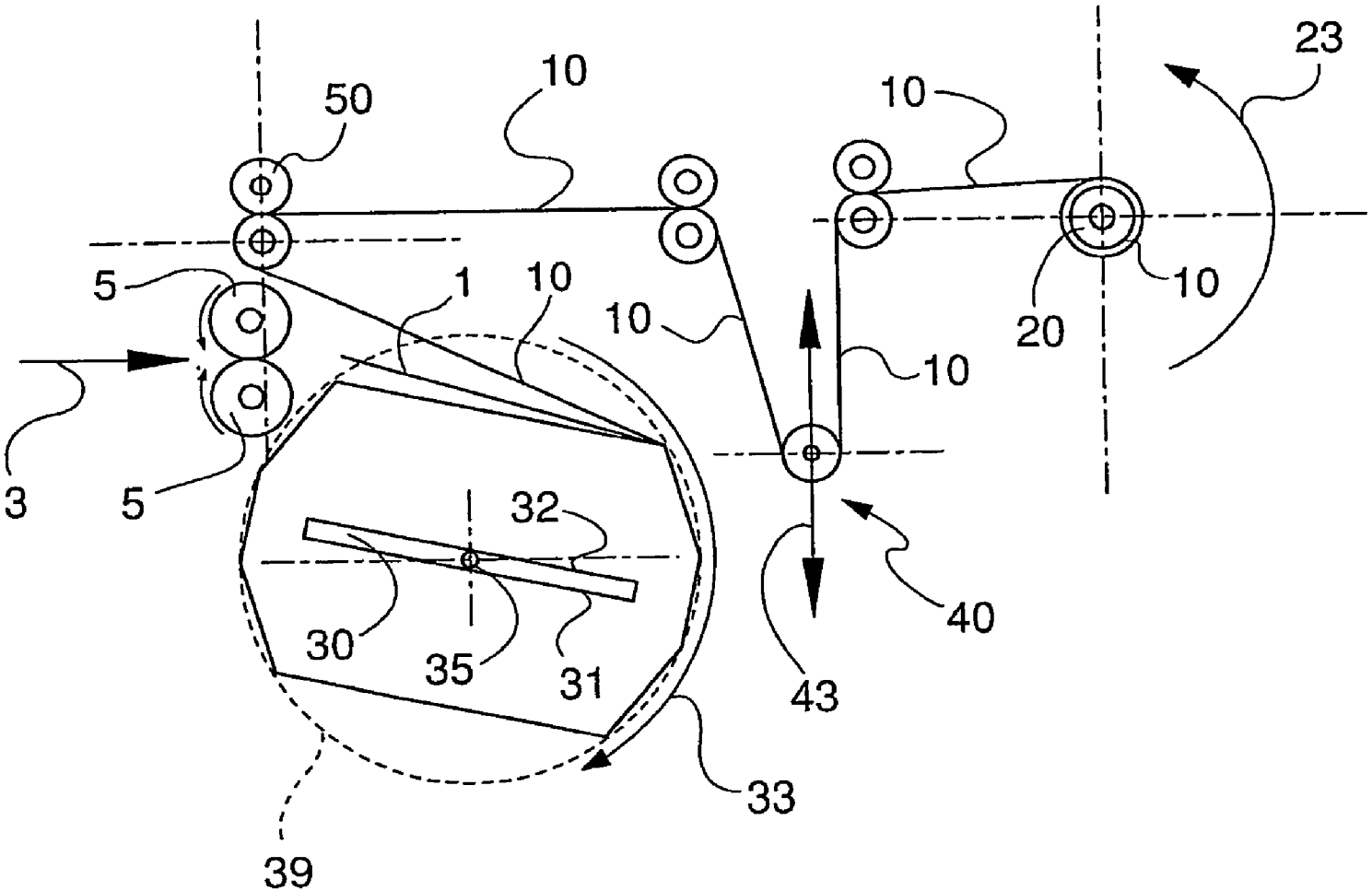

FIGS. 1A and 1B illustrate a device for storing and/or dispensing banknotes according to one possible embodiment of the present invention. The device is represented whilst storage of a banknote 1 is in progress, both in the condition of magazine empty (FIG. 1A) and in condition of magazine full (FIG. 1B).

In this embodiment, the device basically comprises a ribbon means 10, formed by a film that is wound and unwound between a take-up member 20, formed by a cylindrical roller, and a supporting device 30, formed by a substantially rectangular plate, which has two opposite plane surfaces 31 and 32.

Each banknote 1 arrives at the device in the direction indicated by the arrow 3 and is transferred to the supporting element 30 by a pair of rollers 5 set in contact with one another, which turn in opposite directions of rotation and one of which is driven by an electric motor (not illustrated). During rotation of the supporting element or plate 30, the film 10 rolls around the plate, thus enclosing the banknotes so that they are laid exclusively in a position corresponding to the two plane faces 31 and 32.

During the steps of storage of the banknotes, the film 10 is wound on the plate 30, which is driven in rotation by an electric motor (not illustrated) in the direction of the arrow 33. The plate 30, which can be made, for example, of a light metal or other suitable material, is rotated with respect to a shaft 35 having an axis that is substantially parallel to one of the sides of the plate itself. In the embodiment represented, the axis of the shaft 35 practically coincides with one of the axes of symmetry of the plate 30, but it is not ruled out that, for particular applications, the axis of rotation may not coincide with the one represented.

The film 10 that is wound on the plate 30 is taken up by a take-up roller 20, which is also driven in rotation by an electric motor (not illustrated) in the direction of the arrow 23. In practice, one of the extreme ends of the film is fixed to the plate 30, whilst the other end is fixed to the take-up roller 20. The film 10 is initially wound on the take-up roller 20 in an amount sufficient for the maximum number of banknotes that are to be stored in the device.

As the banknotes are introduced, the volume of the banknotes 1 and of the film 10 on the supporting element 30 increases, assuming a shape that may be likened to an irregular polygon, at the most achieving the shape represented schematically for example in FIG. 1B, i.e., a polygon that can be inscribed in a circle 39 represented by a dashed line in FIG. 1B. Said shape is obtained in an altogether natural way above all if the plate 30 has the same dimensions as, or rather even slightly larger dimensions than, those of the banknotes to be stored.

During storage of the banknotes, starting from the condition represented in FIG. 1A, it is possible to note that the increase in diameter of the circumscribed circle 39 with respect to the size of the plate 30 is determined almost exclusively by the superposition of the layers of film 10 on the edges of the plate 30, whilst the thickness of the banknotes and film that accumulate on the two plane faces 31 and 32 has a smaller effect in the increase in diameter.

The above fact enables a large number of banknotes to be stored, at the same time keeping fixed the position of the last pair of rollers 5 that carry the banknotes up to the supporting element or plate 30. This represents a considerable advantage as regards the simplicity of construction of the known devices, in which the mechanism for pushing the banknotes into the device must frequently be rendered mobile in order to enable adaptation to the diameter of the cylindrical storage rollers. The rollers 5 hence remain in a fixed position, so guaranteeing transmission of the motion to the individual banknote both when the plate 30 is full and when it is empty.

Furthermore, rotation of the plate 30 and arrangement of the film being wound favour accommodation of the banknotes on the plate itself, and this applies also in the case where the banknotes 1 are "launched" at the output from the rollers 5.

The film 10 located on the take-up roller 20 can follow various paths, such as, for example, the one represented in FIGS. 1A and 1B.

In the embodiment illustrated herein by way of example, there are provided means for controlling traction, consisting, for example, of a "dandy-roller " system 40 and a braking system 50 in order to build up a supply of film 10 between the roller 20 and the plate 30. Such a system, which acts by gravity or by the return action of springs or elastic means, is widely used, for instance, in rotary presses or the like.

Connected to the dandy roller 40 are two sensors (not represented), which detect two reference positions of the take-up roller 20 along the vertical range of action of the dandy roller upwards and downwards (indicated by the two-headed arrow 43) between the two pre-set positions. During insertion of the banknotes, the motor that drives the take-up roller 20 starts to turn so as to cause unwinding of a certain amount of film 10 from the roller 20. The film 10 released by the roller 20 is taken up by the dandy roller 40, which shifts downwards.

When the dandy roller 40 reaches the pre-set bottom position, the sensor associated to said position brings about arrest of the motor for driving the take-up roller 20. As one or more banknotes are inserted, the motor that drives the plate 30 turns and winds a certain amount of film 10, namely a part of the supply generated by the dandy-roller system 40.

The dandy roller 40 then goes back up and when it reaches the position corresponding to the top sensor, the motor that drives the take-up roller 20 starts unwinding again in order to release an amount of film sufficient to restore the supply. The motor that drives the plate 30 in rotation must therefore overcome only the pre-set force of the system for controlling traction and consequently does not need to draw along also the take-up roller 20, together with the mechanisms connected thereto (motor, etc.). During the storage step, the braking system 50 exerts only a slight action capable of maintaining proper tensioning of the film 10.

In the step of dispensing the banknotes, the motor that drives the take-up roller 20 receives a command to rewind the supply of film 10 that may still exist. The top sensor of the dandy roller 40 brings about unblocking of the braking system 50, which annuls or markedly reduces its intensity so as not to oppose any resistance to the action of take-up of the film 10 by the take-up roller 20.

The motor that drives the plate 30 starts to rotate the plate in the unwinding direction. This brings about release of the film and hence sequential dispensing of the banknotes contained in the device. At the same time, the take-up roller 20 is driven in rotation in order to rewind the film released by the plate 30.

Since it is the plate 30 itself that unwinds the film, the motor that drives the take-up roller 20 only has to rotate at an adequate speed in order to ensure take-up of the film that has been unwound, but does not require any power for pulling the plate 30 or the other members associated thereto.

The device thus designed enables control, in a particularly simple way, of the motors for driving the plate 30 and the take-up roller 20, rendering control of each one of them independent of the other. In fact, the motor of the take-up roller 20 rotates autonomously in the direction of unwinding, providing a supply of free film of a length greater than the one required for enclosing one or more banknotes. When the plate rotates for winding the film 10 around the banknotes, it uses the supply of film (or part thereof) and only needs to overcome the force of the system for controlling traction. The force of the dandy-roller system 40 is calibrated in such a way as to obtain just the right tensioning of the film and consequently the best possible stacking of the banknotes on the plate itself.

The braking system 50 can, for example, be built with devices that rotate in just one direction (such as the one represented in FIGS. 1A and 1B), which are able to brake travel of the film 10 in the direction of the plate 30, i.e., in the stage of winding of the film 10 and hence of introduction of the banknotes, but which are free to rotate without opposing any resistance in the opposite direction, i.e., in the stage of take-up of the film by the take-up roller 20 when the plate 30 rotates in the unwinding direction (and hence in the direction of dispensing of the banknotes contained therein).

Alternatively, the braking system may also be obtained using a clamping device driven by a solenoid and pushed by a spring or by a calibrated weight.

Thanks to the means for controlling traction it is not necessary to control the speed of the film since it is sufficient to synchronize the r.p.m. of the motor that drives the plate 30 with the rate of introduction of the banknotes into the storage device. In fact, in the device according to the invention there are always stored two banknotes at each turn of the plate 30.

Figure 1C:
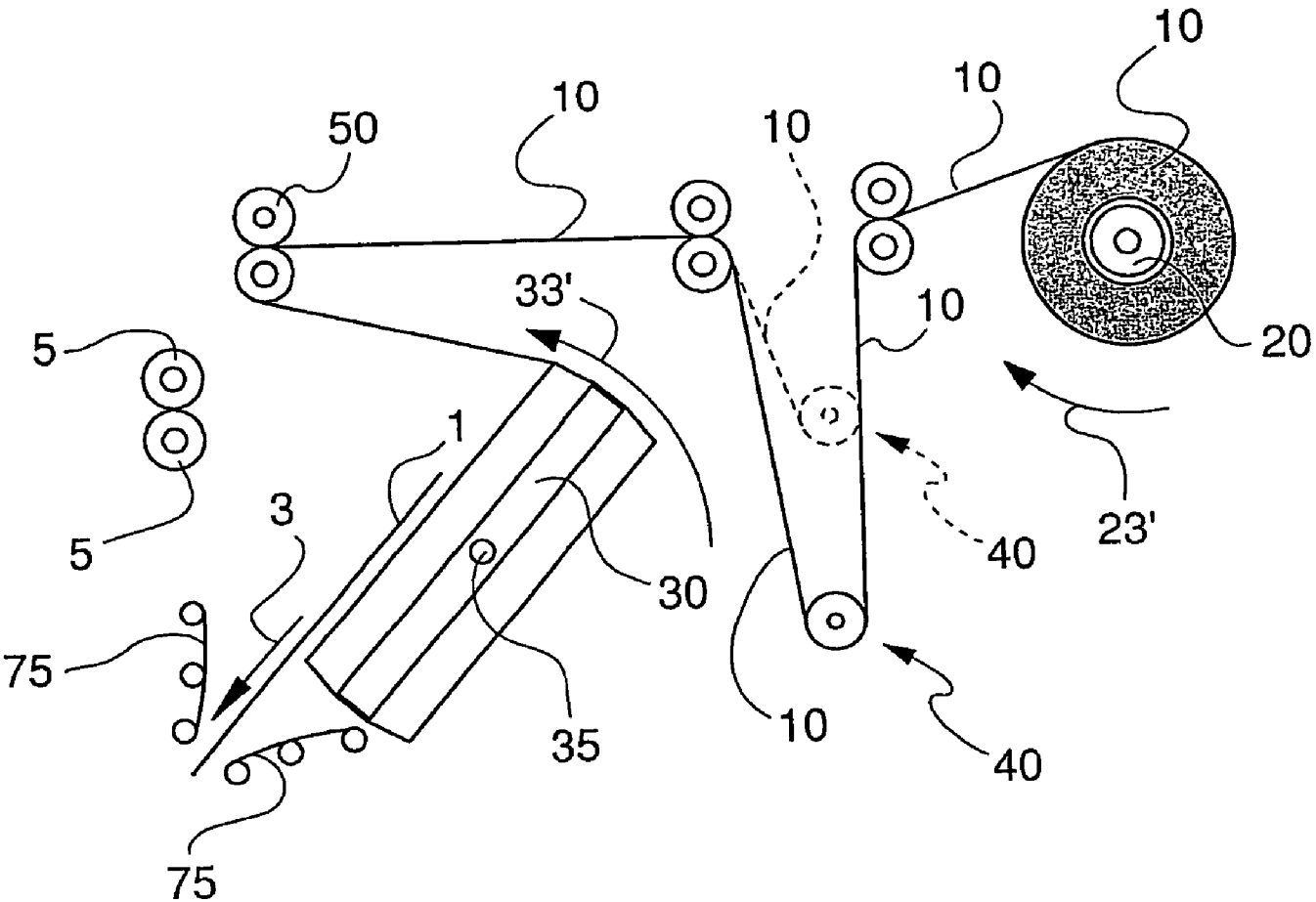
FIG. 1C is a schematic illustration of the dispensing of a banknote by the device illustrated in FIGS. 1A and 1B.

FIG. 1C is a schematic illustration of the operation of dispensing a banknote 1 by a device like the one represented in the views of FIGS. 1A and 1B.

In this step, the plate 30 is set in rotation about the shaft 35 in the direction indicated by the arrow 33', and the take-up roller 20 is set in rotation according to the direction of the arrow 23'. As already mentioned, the dandy-roller system 40 oscillates between a bottom position (solid line) and a top position (dashed line), thus enabling the controls of the electric motors that drive the plate 30 and the take-up roller 20 to be rendered independent.

It may be noted that, in the embodiment of the device represented in FIGS. 1A-1C, the banknotes that have previously been stored as they pass through the rollers 5, come out, instead, along a path different from the incoming path. In fact, as indicated by the arrow 3', the banknote 1 is released by gravity, or else possibly with the aid of appropriate means, in the direction of guide members 75, which in turn direct it towards an underlying conveyor (not illustrated).

FIGS. 2A-2F illustrate, in a highly schematic way, some steps of storage of the banknotes in a device according to the present invention. The same reference numbers as the ones used for the embodiments already illustrated in FIGS. 1A-1C are also adopted here.

The banknotes are sent in sequence to the storage device. They may be inserted manually, one by one, or according to a sequence produced by one or more devices set upstream of the storage device and capable of singling out each banknote from a wad. The singling-out system may be used also for sending banknotes of different denominations to more than one storage device set along a given path. Set along this path are deviating systems which direct the individual banknote to the corresponding storage device according to its denomination or currency.

In any case, the banknotes move, being drawn along by appropriate means, the last ones of which along the path are here illustrated as rollers 5, set immediately upstream of the device and by an idle wheel 52 that is in contact with the film and is moved by the film itself.

In all of the steps represented herein, it is not illustrated that the braking system is located on the axis of the roller 20 or on the film along its path, said braking system being associated to a guide member like the one designated by 51, and that it is driven in rotation in a direction and at a speed such as to maintain always the correct tension of the film 10. Not represented herein, for reasons of clarity, although they may be present, are further systems for control of traction, such as, for example, the dandy-roller system 40 already illustrated in FIGS. 1A and 1B.

Figure 2A:
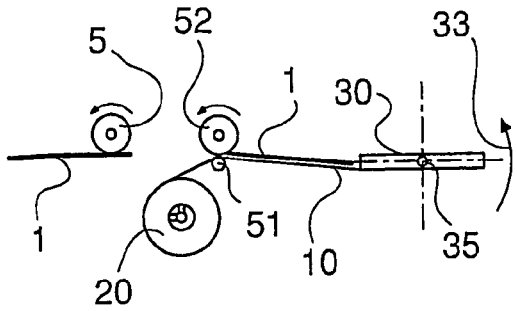
FIGS. 2A-2F are schematic illustrations of some steps of storage of the banknotes in a device according to the present invention.

FIG. 2A is a schematic illustration of the arrival of a banknote 1, through one or more rollers 5 (only one of which is represented), and deposit thereof on the film 10. Upon arrival of the banknote 1, which is detected for example by appropriate sensors located at or in the proximity of the rollers 5, rotation of the plate 30 is started in the direction indicated by the arrow 33. At the same time, the film 10 is recalled by the take-up roller 20.

Figure 2B:
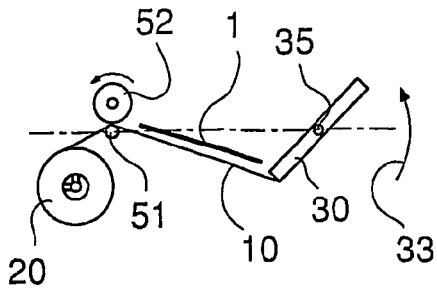

As the plate 30 rotates, since the axes of the guide member 51 and of the shaft 35 are aligned on one and the same horizontal plane, the film 10 is inclined downwards, so facilitating transfer of the banknote 1 in the direction of the plate 30, as represented in FIG. 2B. The same steps as those illustrated in FIGS. 2A and 2B are represented more clearly, in perspective, in FIGS. 4A-4C, in which for example two idle conveying wheels or rollers 52 can be distinguished.

Rotation of the plate 30 proceeds until a quarter of a turn (90° with respect to the initial position) has been accomplished. In this condition, represented in FIG. 2C, the banknote 1 has reached its storage position, and rotation of the plate 30 proceeds (see FIG. 2D) until the banknote 1 is enclosed between the film 10 and one of the plane faces of the plate 30 (or else a preceding winding of the film 10 already wound on the plate), as represented in FIG. 2E. The banknote is thus stored on a plane support and can be maintained in said position even for a long time without damaging the paper material of which it is made.

In the case where a second banknote 2 is arriving, as represented schematically in the same FIG. 2E, the rotation of the plate 30 proceeds, thus also helping the banknote 2 to reach the other plane face of the plate 30, i.e., the plane face opposite to the one on which the banknote 1 has been stored.

Figure 2C:
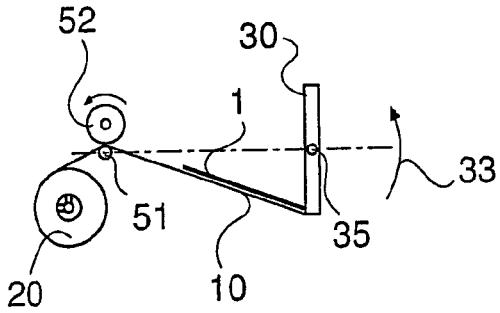
Figure 2D:
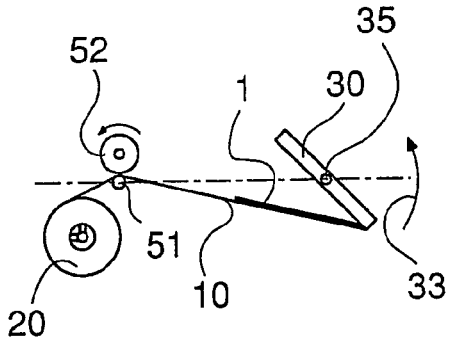
Figure 2E:
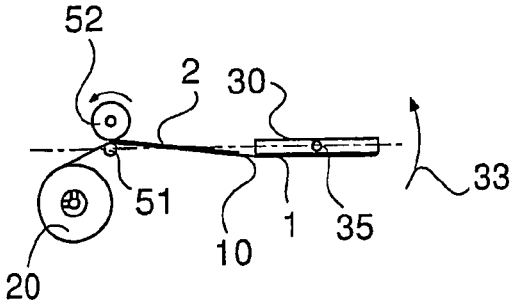
Figure 2F:
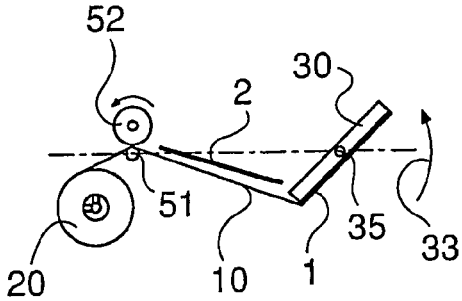

From the condition represented in FIG. 2F (which is similar to that of FIG. 2B), storage of the banknote 2 proceeds in a way substantially similar to what is represented in FIGS. 2C-2E for the banknote 1. At each complete turn of the plate 30 it is thus possible to store two banknotes.

FIGS. 3A-3F, instead, illustrate in a very schematic way, some steps corresponding to the dispensing of a banknote 1 that has previously been stored in a device according to the present invention. In each of these views, there appear the same elements already illustrated in FIGS. 2A-2F.

In this case, the idle roller 52 rotates in the direction opposite to the previous one and concurs to maintain the correct tension of the film 10. Also the plate 30 is driven in rotation in the direction opposite to the previous one, indicated in this case by the arrow 33'. Just as in the schematic representations of FIGS. 2A-2F, for reasons of simplicity further systems for control of traction are not represented.

Figure 3A:
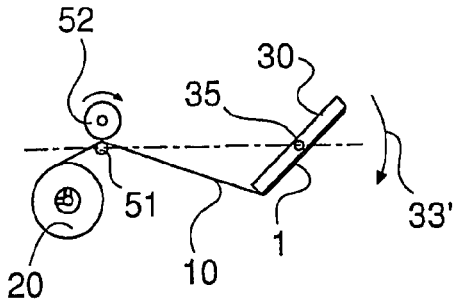
FIGS. 3A-3F are schematic illustrations of some steps of dispensing of the banknotes by a device according to the present invention.
Figure 3B:
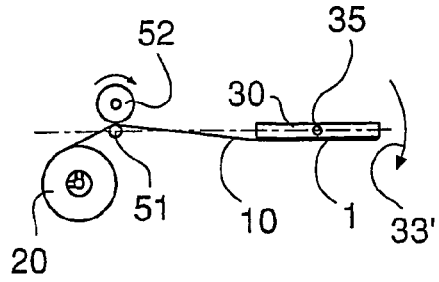
Figure 3C:
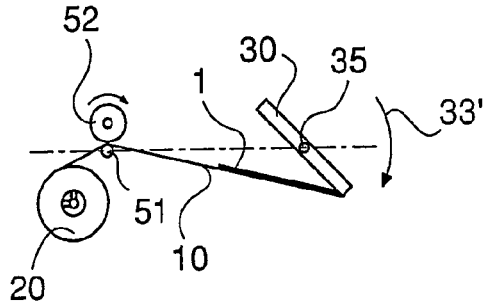
Figure 3D:
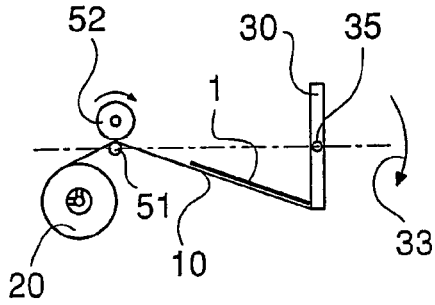

When dispensing of one or more banknotes is requested, the plate 30 is driven in rotation in the direction of the arrow 33', and the film 10 is taken up on the take-up roller 20. In FIGS. 3A and 3B, the banknote 1 is still enclosed between the film 10 and the plate 30 (or an underlying winding of the film 10 on the plate 30).

As the rotation of the plate 30 proceeds and as the film 10 is unwound from the plate itself, the banknote 1 is released from the film 10 (FIGS. 3C-3E) and remains resting on the film 10, so advancing in the direction of the roller 52, whilst the film 10 is recalled on the take-up roller 20.

Figure 3E:
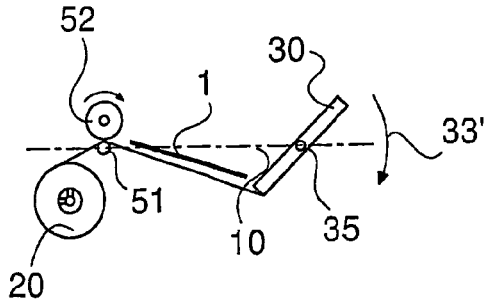
Figure 3F:
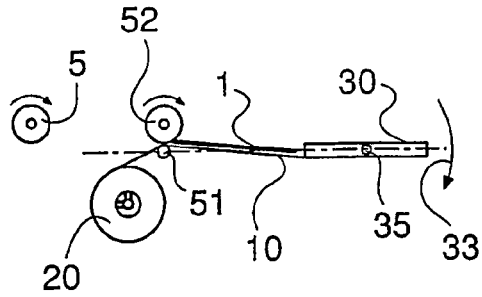

Once the roller 52 is reached, as represented in FIG. 3E, the banknote 1 is guided in the direction of the roller 5, which will direct it to a system for conveying it towards a dispensing opening of the machine equipped with such a device. The plate 30 may possibly proceed in its rotation (position similar to that of FIG. 3C) in the case where dispensing of more than one banknote has been requested.

In addition to the modes of storage already illustrated in FIGS. 2A-2F and 4A-4C, in which the banknotes are fed in a direction parallel to the direction of sliding of the film 10, the device according to the present invention moreover enables feed of the banknotes in a direction substantially perpendicular to the direction of sliding of the film 10.

For instance, FIGS. 5A-5C illustrate some steps of storage of a banknote 1, which arrives crosswise with respect to the direction of advance of the film 10 (FIG. 5A) and is deposited directly on one of the plane faces of the plate 30 (FIG. 5B) or else on a winding of film 10 already present on the plate 30. As rotation of the plate 30 proceeds (FIG. 5C) the banknote 1 will be withheld in a plane condition between the plate 30 and the film 10.

Figure 6A:
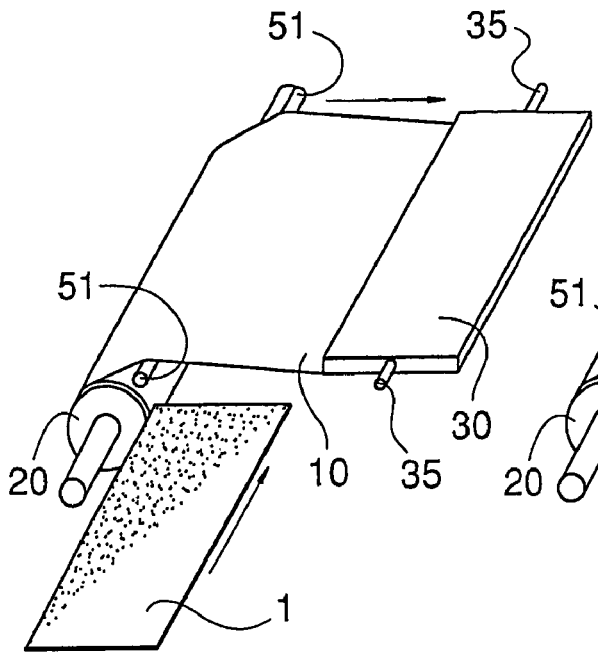
FIGS. 6A-6C are schematic illustrations, in perspective, of some steps of storage of a banknote that arrives along a path perpendicular to the direction of advance of the film in the device and is deposited on the film.
Figure 6B:
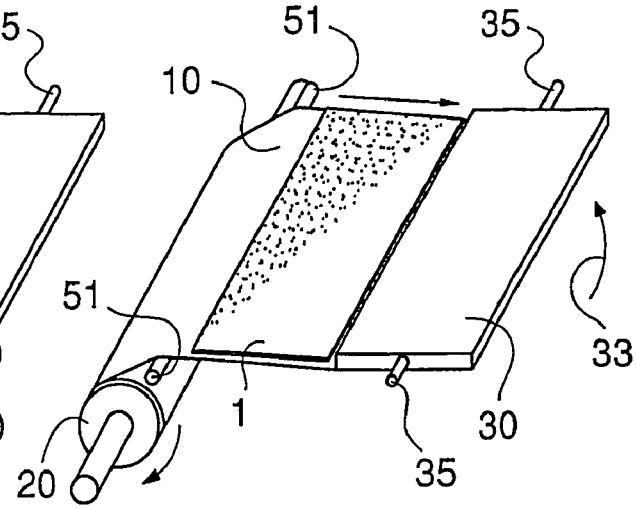
Figure 6C:
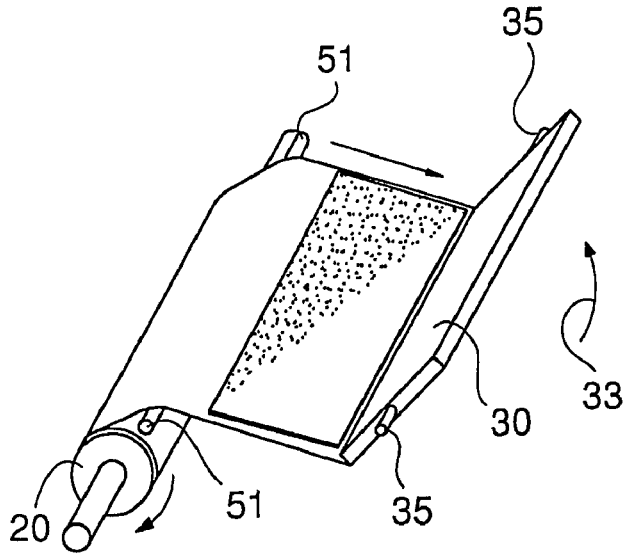

In FIGS. 6A-6C (in which, for reasons of clarity of representation, the rollers 52 are not illustrated), the banknote 1 arrives also in this case crosswise with respect to the direction of sliding of the film 10 (FIG. 6A) but is deposited on the film 10 (FIG. 6B) instead of on the plate 30. However, as occurs in the step already illustrated in FIG. 4C, the subsequent rotation of the plate 30 (FIG. 6C) enables enclosing of the banknote 1 between the plate 30 and the film 10.

With the alternative embodiments illustrated in FIGS. 5A-5C and 6A-6C it is possible, for example, to dispense the banknotes following a path different from what is envisaged for storage. The banknotes can thus be dispensed subsequently in a direction parallel to the direction of sliding of the film 10, as represented schematically in FIGS. 3A-3F, or else there may be provided means (for instance, brushes, rubberised wheels, suction systems), which enable directing of the banknotes being dispensed in a pre-set direction, possibly coinciding with the direction of arrival.

So far the case has been illustrated where the banknotes are inserted in a crosswise direction, i.e., with the shorter side parallel to the direction of movement of the film. However, it is also possible to envisage that the banknotes may be inserted lengthwise. Consequently, the plate 30 will have dimensions and assembly that can privilege the smaller diameter of the circle described in rotation (banknotes that move in the direction parallel to the short side), or else privilege the width of the device, to which there corresponds a diameter of rotation correlated to the long side of the banknotes themselves.

FIGS. 7A-7G illustrate, for example, some steps of dispensing a banknote 1 by a device according to the present invention. In this case, the previous banknotes, which have been stored as illustrated in FIGS. 2A-2F, can instead be dispensed always parallel to the direction of sliding of the film 10, but coming out on the side opposite to that of arrival.

In all the views of the steps illustrated in FIGS. 7A-7G, in addition to some of the elements already illustrated in the previous sequences, there are schematically illustrated a rotating brush 60 or other similar means (they may be even more than one), which has the job of turning over the banknotes released from storage, as well as a conveyor 70 for the transfer of the banknotes. Also illustrated is a guide member 55 for the film 10, said guide member being set in the proximity of the plate 30.

Figure 7A:
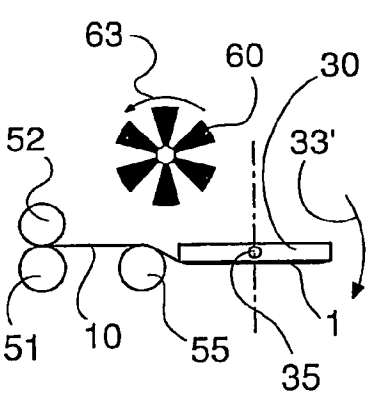
FIGS. 7A-7G are schematic illustrations of another possible mode of dispensing a banknote, using a device according to the present invention.
Figure 7B:
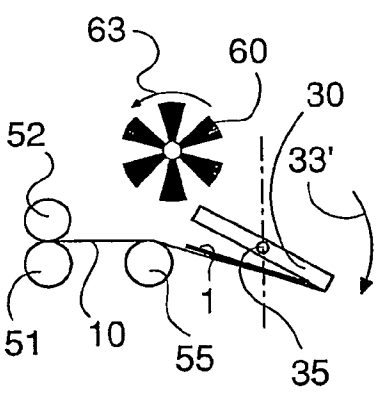
Figure 7C:
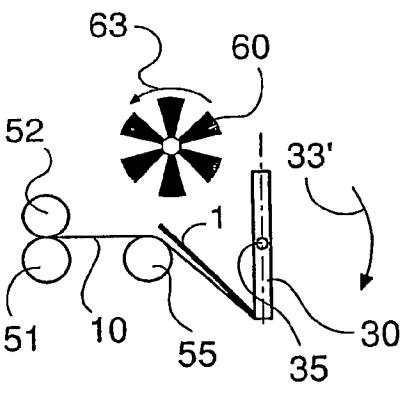
Figure 7D:
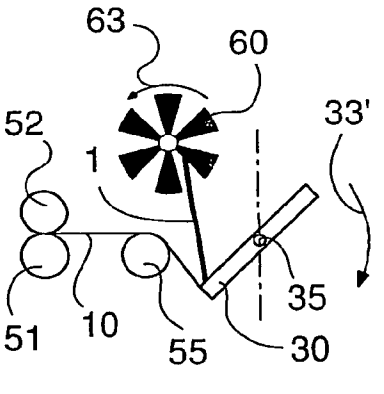
Figure 7E:
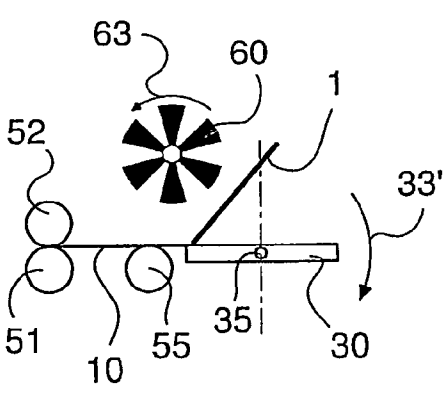
Figure 7F:
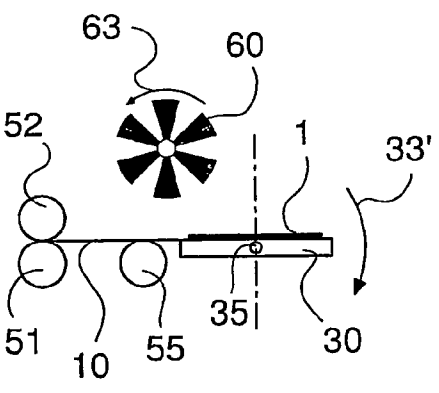

In the condition illustrated in FIG. 7A, the banknote 1 is still stored between the film 10 and the plate 30, with the latter driven in rotation in the direction of the arrow 33'. As rotation proceeds (FIGS. 7B and 7C), the length of film 10 between the guide member 55 and the edge of the plate 30 is lowered. The banknote 1 is pushed by the plate 30 and, by resting on the guide member 55, is raised until it is intercepted by the rotating brush 60 (FIG. 7D).

Figure 7G:
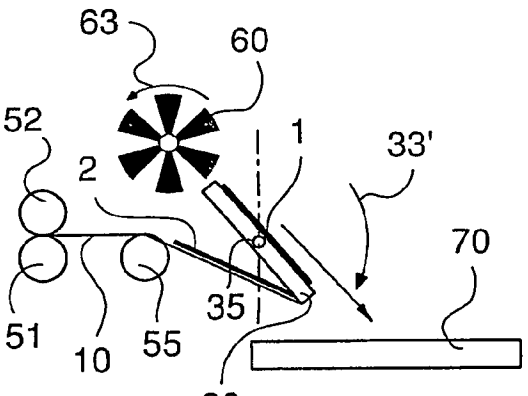

The rotating brush 60, which is driven in rotation in the direction of the arrow 63, turns the banknote 1 over and brings it onto the same face of the plate 30 where it was placed previously (FIGS. 7E and 7F) so that, as rotation of the plate 30 proceeds, the banknote 1 can be deposited by gravity (or directed by appropriate rotating means or the like) in the direction of an underlying conveyor 70, as is represented in FIG. 7G. At the same time as the banknote 1 is released by gravity, another banknote 2 is released from the rotating pack and directed towards the brush 60 and subsequently dispensed in the same way (the process takes up in particular from the step illustrated in FIG. 7C and proceeds, in the subsequent steps, until the banknote 2 is deposited by gravity, and so on).

The embodiments so far represented envisage the use of a single film (or ribbon). The film 10 is preferably made of polyester, treated so as to be antistatic, and having a non-smooth surface, for example an embossed one.

According to an alternative embodiment of the present invention, the device for storing and/or dispensing banknotes can be made also with two films. FIGS. 8A-8H present a device thus made.

Figure 8A:
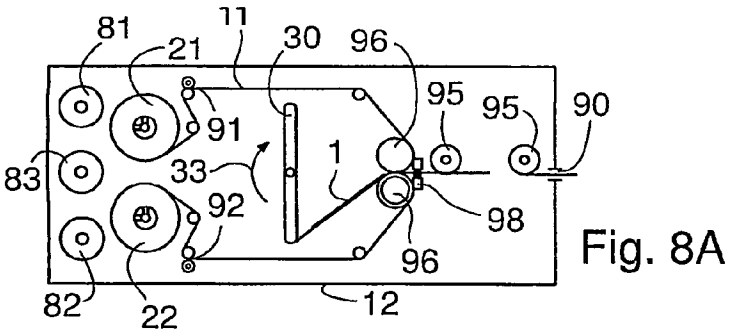
FIGS. 8A-8G are schematic illustrations of some steps of storage of banknotes in a device according to the embodiment that envisages the use of two films.
Figure 8B:
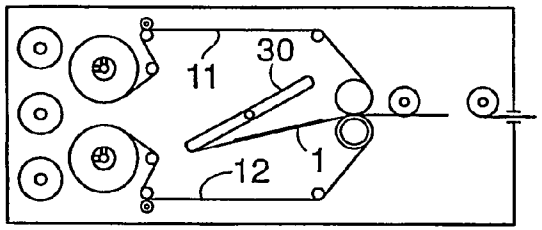
Figure 8C:
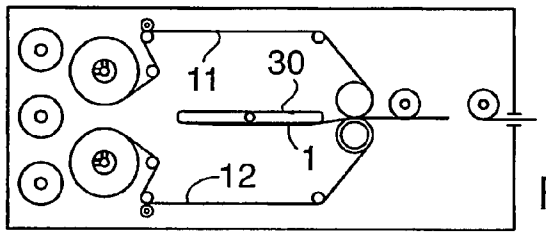
Figure 8D:
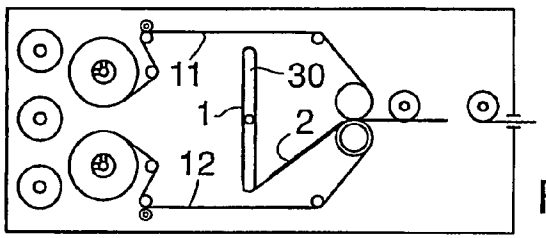
Figure 8E:
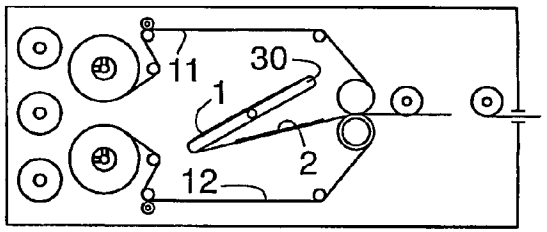

The elements that make up this alternative embodiment are basically illustrated with reference to FIG. 8A, wherein a rotating surface 30 is visible, which, during the steps of storage, rotates in the direction indicated by the arrow 33.

Fixed to the plane 30 are the two films 11 and 12, wound on respective distinct take-up rollers 21 and 22. Also illustrated schematically are the motors 81 and 82 for driving respective take-up rollers 21 and 22 in rotation, as likewise the motor 83, which drives the plate 30 in rotation. Set along the path of the films 11 and 12 are systems for controlling traction, for example braking systems 91 and 92 for maintaining the correct degree of traction of the films 11 and 12 between the respective take-up rollers 21 and 22, and the rotating plate 30. The banknotes enter and exit from the device through one and the same opening or gap 90 and are transferred by appropriate transfer means 95 until they reach a position corresponding to a system of sensors 98 (represented only in FIG. 8A).

In the storage step, the banknotes are pushed up to a given position by systems external to the device, whilst the plate 30 is in a waiting position.

Immediately after the banknote has reached the system of sensors 98, its front edge reaches the rollers 96, around which the films 11 and 12 are partially wound. The plate 30 is then driven in rotation, drawing along with it the films 11 and 12, and consequently the banknote is inserted between the two films, as illustrated schematically in FIGS. 8A and 8B.

As rotation of the plate 30 proceeds, the banknote 1 enclosed between the films 11 and 12 is set in a position corresponding to one of the two plane faces of the plate 30.

Figure 8F:
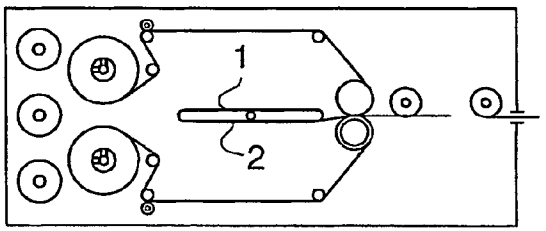

In the case where a second banknote 2 is arriving (FIG. 8D), the plate 30 proceeds in its rotation, and also the banknote 2 is inserted between the two films 11 and 12. Rotation proceeds (FIG. 8E) until also the banknote 2 comes into a position corresponding to the other plane face of the plate 30 (FIG. 8F).

The plate 30 draws the films 11 and 12 off the respective rollers 21 and 22, unwinding the necessary amount thereof with each half-revolution. Since the rollers 21 and 22 do not involve a particular stress, the tensile force exerted by the plate 30 could bring about unwinding of the film in excess. The braking systems 91 enable onset of such a drawback to be prevented and can, if necessary, be deactivated in the dispensing step in order to enable the motors 81 and 82 to rewind the films 11 and 12 on the respective rollers 21 and 22, without having to overcome the force of the braking system.

Figure 8G:
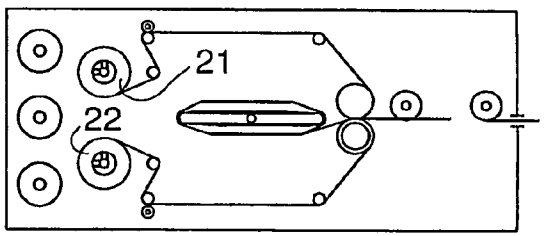

The next FIG. 8G shows a further step of intermediate storage of the device. It is thus possible to note the progressive increase, as well as the shape assumed by the ensemble made up of the films, the banknotes, and the rotating plate, whilst the diameter of the rollers 21 and 22 of the films 11 and 12 decreases progressively.

It may be noted how the synchronisation of the turns of the plate 30 with the introduction of the banknotes enables, at each half-turn of the plate itself, introduction of a banknote that is deposited in a position corresponding to each of the plane faces of the plate.

Figure 8H:
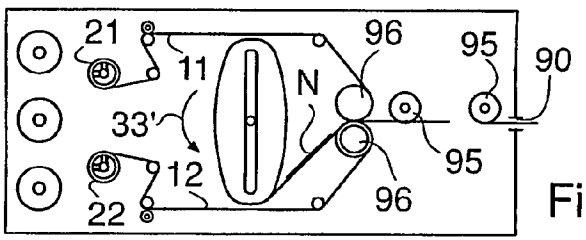
FIG. 8H is a schematic illustration of the dispensing step of a banknote by the two-film device of FIGS. 8A-8G.

FIG. 8H illustrates, instead, the dispensing stage of a banknote N starting from a condition of complete storage. As may be noted, the plate is set in rotation according to the direction of the arrow 33' (opposite to that of the arrow 33) whilst the rollers 21 and 22 progressively take up the films 11 and 12. The banknote N, enclosed between the two films 11 and 12, is thus brought back in the direction of the rollers 96, where it is released from the films 11 and 12 and directed, via the transfer means 95, in the direction of the aforesaid gap or opening 90, through which it had been stored.

In greater detail, during the dispensing step, the plate 30 performs as many half-turns as is the number of banknotes to be dispensed. Each banknote repeats the entry path in reverse, and the films 11 and 12, together with the rollers 96, facilitate its transfer. When the system of sensors 98 is reached, the rollers 95 and the external transfer wheelworks start to turn in order to expel it completely. The external wheelworks could even be absent if the banknote were introduced manually, through the gap 90, being set directly between the rollers 96, and expelled in the dispensing step by the rollers 96 themselves through the gap 90.

During the dispensing step, once rotation of the plate 30 has been started, also the motors 81 and 82 of the take-up rollers 21 and 22 are actuated. The motors 81 and 82 rotate during winding at a speed higher than the speed of unwinding, but have a smaller power than the motor 83, which turns the plate 30, and hence the rollers 21 and 22 do not interfere with the motion of the plate 30. This determines correct take-up of both of the films unwound and consequent expulsion of the banknotes.

Alternatively, it is also possible to use a single motor to drive the two take-up rollers 21 and 22. Said rollers are driven via pulleys with cylindrical belts, which can slide slightly. This allows a clutch effect to be obtained in such a way that just one motor can keep the same tension and the same pull on both of the films 11 and 12. In fact, in the case where a film reaches the required tension whilst the other is still slack, the belts slide on the pulley of the roller which is already tensioned and continue to cause the pulley associated to the other roller to rotate, instead, until correct tensioning of the corresponding film is achieved.

It should be noted that, with a rotating plate having dimensions such as to be able to receive one banknote per face when the banknote is introduced in the direction of its smaller side, it is also possible to introduce banknotes in the direction of their longer said. The latter banknotes will be wound on the plate folded approximately in two, as frequently occurs in wallets.

This obviously reduces the storage capacity, also because the thickness of the banknote contributes to increasing the dimensions of the plate also at its edges. However, the banknotes remain much less deformed than with traditional rollers and naturally reassume their flatness after they have been dispensed.

For simplicity of representation, there has so far been illustrated a plate 30 provided with two plane resting surfaces. However, in some cases, it may be advisable to use a rotating plate having resting surfaces of a different shape.

Figure 9A:
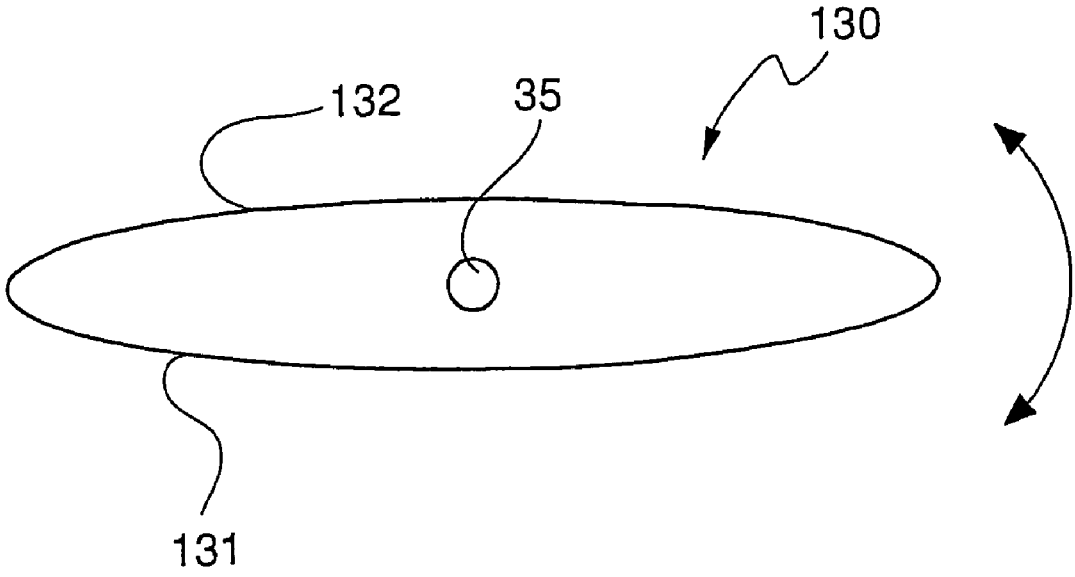
FIGS. 9A and 9B are views that are schematic illustrations of some alternative embodiments of a supporting element for a device according to the present invention.
Figure 9B:
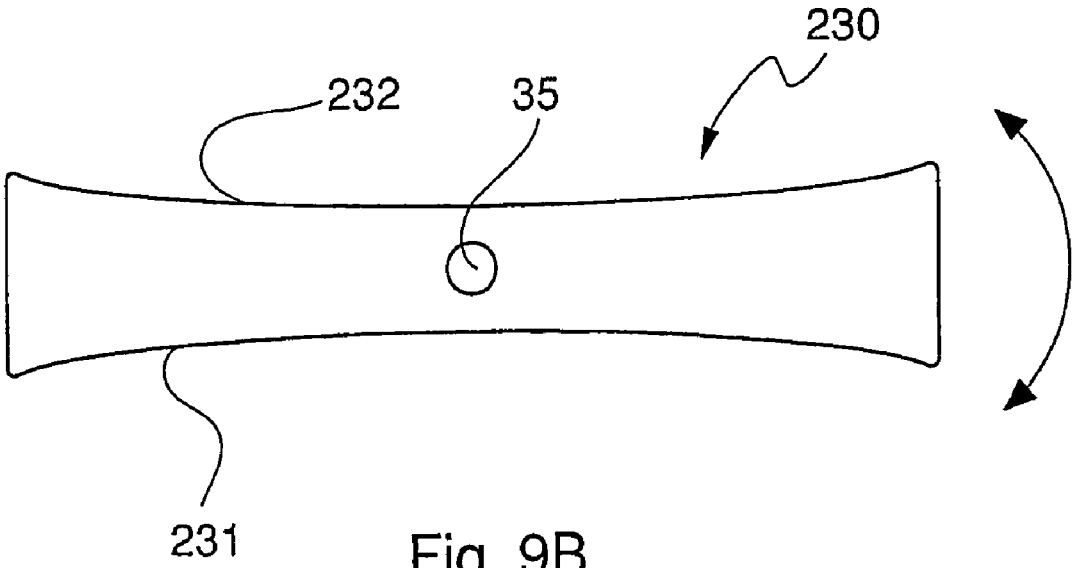
Figure 10A:
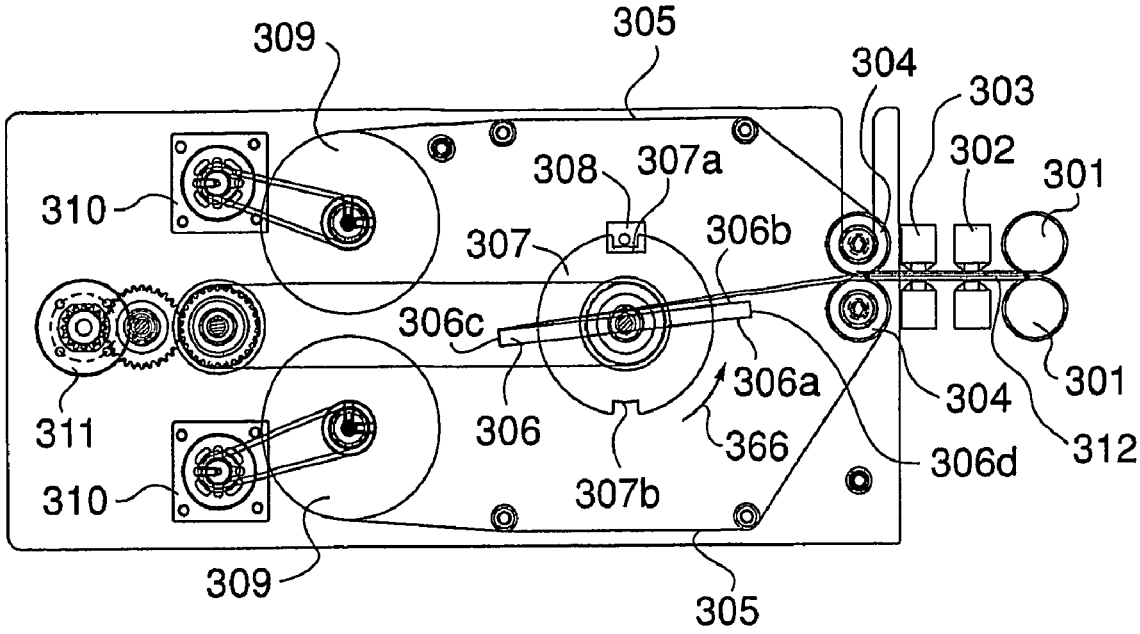
Figure 10B:
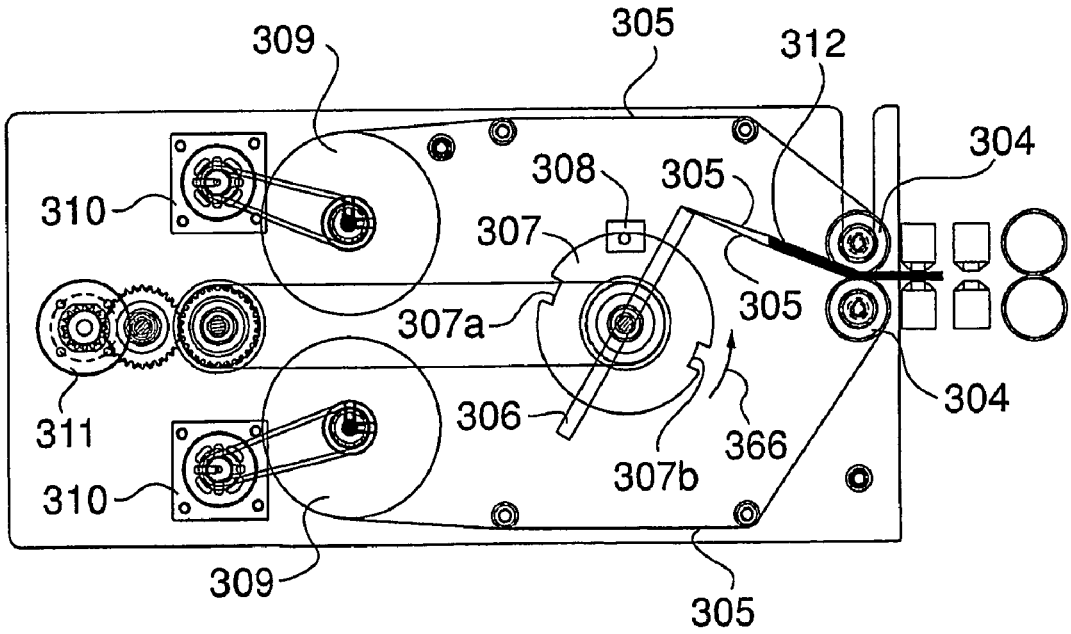
Figure 10C:
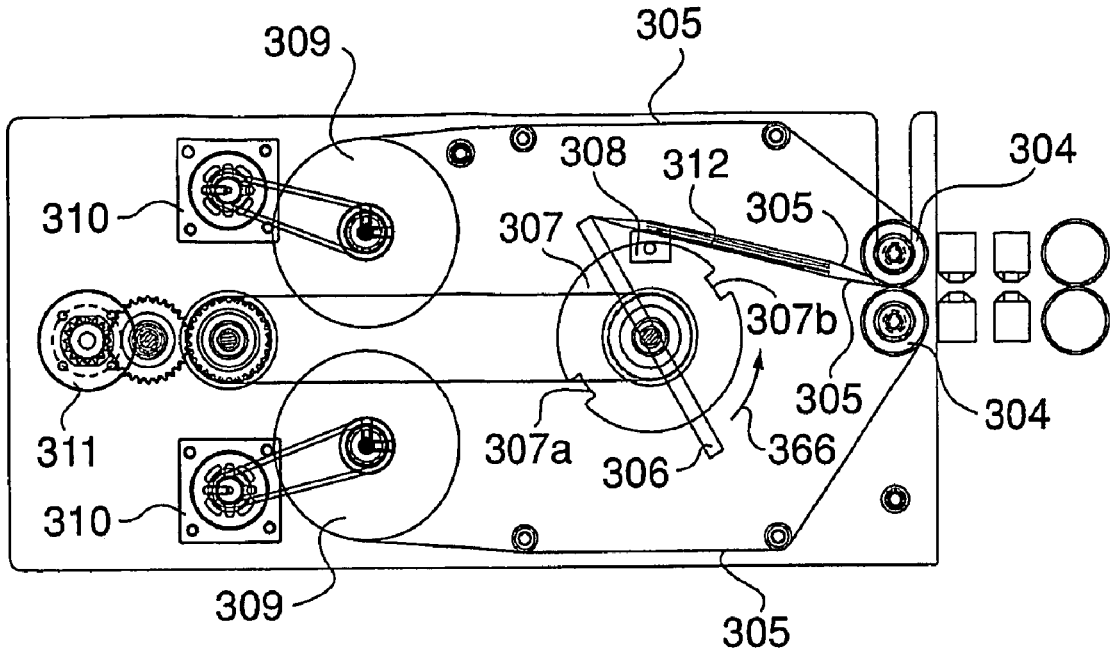
Figure 10D:
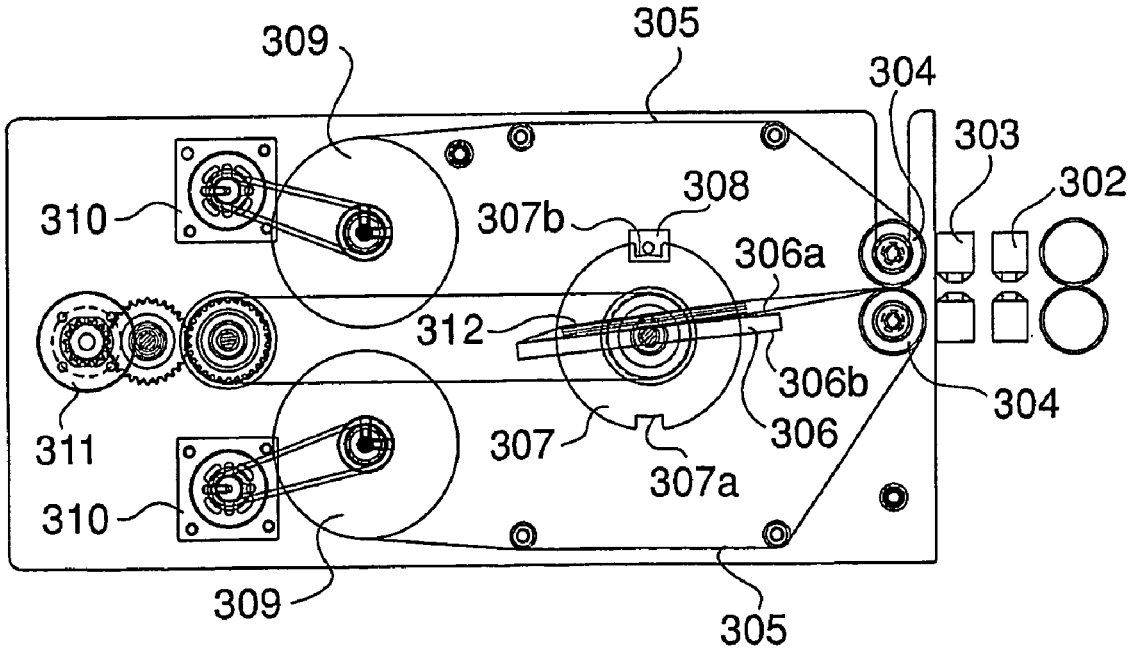

FIGS. 9A and 9B illustrate some alternative embodiments for the rotating plate of a device according to the present invention.

The plate 130, illustrated in FIG. 9A, envisages, for example, two opposed resting surfaces 131 and 132 having a slightly convex shape, whilst the plate 230, represented in FIG. 9B, has two opposed surfaces 231 and 232 having a slightly concave shape. One advantage of these alternative solutions is represented by the fact that, given the same width of the plate (or of the diameter of the circle described by the rotation thereof), the surface on which a banknote rests proves greater as a result of the curvature.

FIGS. 10A to 10D illustrate another two-film embodiment of a device according to the invention, with reference to the sequence of depositing a wad of banknotes. The same device may work even with single banknotes exactly in the same way and following the same sequence.

In the resting position (FIG. 10A), the storage plane 306 is located in a practically horizontal position, caused by the arrest of the motor 311 following upon engagement of the photosensor 308 by the notch 307*a* in the photodisk 307. This starting position (which is substantially horizontal) is very favourable for the start of rotation of the storage plane 306 in so far as the starting force that it must exert to overcome the resistance of the reels of film 309 and of the corresponding motors 310 is less than the force that would be necessary if the storage plane started from a vertical position.

In the depositing step (FIGS. 10A and 10B), the incoming wad 312 is pushed by the pulling means 301, which are external to the device, and as it proceeds engages in sequence the photosensors 302 and 303, which detect its passage and direction of sliding. When the wad reaches the pair of rollers 304 (guiding idle rollers of the films 305, the rotation of which is due to sliding of the film), the storage plane 306 starts to rotate in the direction indicated by the arrow 366. Start of the film more rapidly than it is unwound from the storage plane 306.

The result is that the motors 310 are always pulling, thus keeping the films tensioned. This causes rotation of the guiding idle rollers 304. The action of displacement of the films or of rotation of the guiding idle rollers 304 brings about extraction of the wad from the device. The reverse sequence of the sensors 302, 303 and 308 brings about counting during the dispensing step.

It is to be noted that the motors 310 have a speed such as to be able to take up the film unwound from the storage plane 306 in any condition (whether empty or full), but do not have a power such as to affect the rotation of the storage plane itself. They do have, instead, a power sufficient for setting in rotation the guiding idle rollers 304 in the dispensing step.

It must moreover be emphasized that, by driving the motors as described, there is obtained a constant speed of dispensing of the device both when the storage plane is full and when it is empty. Furthermore, it is important for the motor 311 to have a power sufficient for driving, during depositing, the films 305, the guiding idle rollers 304, the reels 309, and the corresponding motors 310.

FIG. 11 illustrates a further two-film embodiment of a device according to the invention, with the storage plane 306 located in a different way from what is illustrated in FIGS. 10A-10D.

In both of the embodiments of FIGS. 10A-D and 11, the banknote (or the wad of banknotes) 312 is practically conveyed by the film 305.

Consequently, to be certain that it will enter totally into the device and that, at the end of the rotation, it will not remain between the films, half way between the rollers 304 and the storage plane 306, it is necessary for the storage plane 306 to pull an amount of film greater than the dimension of the side of the banknote (or wad) 312 parallel to its direction of sliding.

Since, when the surface is empty, the length of film 305 pulled by the surface in each half-turn corresponds approximately to half of the perimeter of the surface itself (viewed in cross section), it is necessary for the dimension of the storage plane 306 to be at least equal to, or greater than, the dimension of the banknote 312. The area of the surface on which the banknote will rest depends upon the starting position of the storage plane 306 and its inclination.

In FIG. 11 it may be noted that the banknote or wad of banknotes 312 arrives from a position nearer to the edge 306*d* of the storage plane 306 as compared to that of FIGS. 10A-D. In fact, in FIG. 11 the storage plane 306 is set closer to the idle rollers 304 and, in the starting position, the storage plane 306 is moreover in a perfectly horizontal position.

It will be understood that the portion of film 305 comprised between the rollers 304 and the front edge 306*d* of the storage plane 306 constitutes approximately the distance (minus the thickness of the storage plane) between the front edge of the banknote and the edge of the storage plane 306. Consequently, it is clear that it is sufficient to incline more or less the starting position of the storage plane in order to set the banknotes in the desired position with respect to the edges of the storage plane itself.

In the examples of FIGS. 10A-D and 11 there has been privileged a starting position of the storage plane substantially or perfectly horizontal because in this position the storage plane 306 is favoured in terms of pulling capability, in so far as in that point the initial path described practically corresponds to just the thickness of the storage plane 306. Clearly, as soon as the surface moves throughout the first 90° of rotation, its torque will decrease, but the initial thrust for starting has already been reached.

Furthermore, the motors 310, in their effort to rewind the films, do not manage to affect the position of the storage plane 306, above all when this is in the horizontal position. Consequently, when the arrest position of the storage plane 306 is reached, there may also be easily obtained a good tensioning of the film so that the motors 310 will pull the film for a slightly longer time for completion of the cycle of the storage plane to be performed.

The different positions of the storage plane 306 in FIGS. 10A-D and in FIG. 11 are useful for understanding that the storage plane 306 could be set in any position within the device and at any distance from the guiding idle rollers 304, without this preventing depositing of the banknotes 312 on the desired area of the storage plane 306. This may, however, entail a banknote that has entered the device possibly reaching the storage plane proper not immediately, but at a certain point of the subsequent cycle. The banknote could therefore remain enclosed between the films 305 and, so to speak, half way between the guiding idle rollers 304 and the storage plane 306 itself.

In any case, it should also be noted that, as the banknotes are deposited, the amount of film pulled by the storage plane 306 increases (as a result of the increase in its half-perimeter with each banknote), and this causes the position of the banknotes with respect to the storage plane 306 to tend to shift in the direction of the external edge (the edge 306*d* for the banknotes that rest on the surface 306*a*, and the edge 306*c* for those that rest on the surface 306*b*) of the storage plane 306 itself.

The above fact does not entail any drawback, provided that the width of the surface is, within reason, greater than the side of the banknote parallel to its direction of displacement. Tendentially, modules having a storage plane 306 of a width greater than the dimension of the largest banknote are built so that it is sufficient to choose the starting inclination of the surface to obtain always the right positioning of any denomination of banknote.

The above embodiments are typically designed for manual depositing of items arranged in wads introduced into the device, such as, for example, wads of banknotes in timed safes, or else telephone cards or the like.

FIGS. 12A and 12B illustrate another possible embodiment of a device according to the present invention. For reasons of clarity of representation, FIG. 12B is a plan view that is very simplified as compared to the side view of FIG. 12A. In this embodiment, the device is made in such a way that the motor 311 (FIG. 12A) of the storage plane 306 will have to overcome exclusively the resistance of the reels 309 but not that of the motors 310. In this embodiment there can be provided an appropriately regulated brake that acts exclusively during pulling of the storage plane 306.

This can be obtained, for example, by mounting each of the pulleys 391 on means for driving in rotation in just one direction, for example a one-directional roller bearing 351, instead of fitting them rigidly to the respective supporting shafts 330 of the reels 309. The roller bearing 351 on each of the pulleys,391 is mounted so as to be in a condition of "engagement" on the respective pulley when the motors 310 turn in the direction of winding of the films on the reels 309 and in the "idle" condition if the motors 310 turn in the direction of unwinding of the films off the reels.

Again on each shaft 330 of the reels 309, for example at the opposite end, there is installed another one-directional roller bearing 350 fixed to a wheel 340, which functions as brake. In this case the brake wheel 340 is in a condition of engagement when the shaft 330 of the reels 309 is made to rotate by the pull of the film by the storage plane 306 (the only shaft 360 of which is illustrated in FIG. 12B) and is in an idle condition when the motors 310 turn, winding film on the reels 309.

The brake wheel 340 can be partially braked, for example, by a sliding block 355 (FIG. 12B), which is set in contact with the wheel 340 with an appropriately regulated pressure.

With this set-up we obtain that, in the step of depositing of a banknote or of any one other item, the storage plane 306 turns in the direction of unwinding of the film from the reels 309. In order for the storage plane 306 not to have to turn also the motors 310, these are driven in rotation too in the direction of unwinding of the film off the reels 309. The result is that, since the speed of the motors 310 is greater than the speed produced by the unwinding of the film pulled by the storage plane 306, the pulley 391 turns faster in order to anticipate rotation of the shaft on which it is mounted by means of the interposed one-directional roller bearing 351. Consequently, the storage plane 306 must only overcome the braking of the reel 309, which is active via the brake wheel 340. In fact, the roller bearing 350 of the brake wheel 340 is in engagement when the reels 309 turn to unwind the film and is idle during rotation in the opposite direction.

Hence, in the step of dispensing the banknotes, the storage plane 306 rotates to release the film, the motors 310 turn to wind the film and exploit the fact that now the roller bearing 351 on each pulley 391 is in an engaging condition. The brake is inactive because, in this direction of rotation, the roller bearings 350 of the brake wheels 340 are idle, and consequently the motors 310 do not have to overcome any load except for the pull of the film.

As an alternative to the embodiment represented, the brake wheel 340 could also be rigidly connected to its own shaft 330, without using the one-directional roller bearing 350. In this case, it is necessary for the sliding-block brake to be controlled, for example, by a solenoid which activates it when the storage plane 306 pulls the film and deactivates it when the film is rewound by the reels 309.

Obviously, even if FIG. 12B represents, for reasons of simplicity, the mechanism of a single reel 309, since it is a two-film device, what has been said must apply to both reels 309.

FIG. 13A illustrates an embodiment of a device formed by two distinct portions 400 and 450 that can be separated from one another, whilst FIG. 13B represents only the removable portion 450.

In this embodiment, all of the motors 410 and 411 are housed in the portion 400, which is designed to be fixed to the machine where the device is installed, whilst the rest of the rotating elements (storage plane, reels, films, etc.) are housed in the portion 450. Transmission of motion from the motors to the rotating members is obtained through a series of gears 460 (FIG. 13B), which mesh with respective gears of the portion 400.

The above enables a version of the device to be obtained for applications in which it also performs the function of removable and transportable box. In this case, it is indispensable for some parts to be fixed on the machine (hence housed, either totally or in part, in the portion 400), such as, for example, the motors and the electronic-control parts, whilst other components remain installed on the removable portion 450.

For example, in the case where the device is used instead of traditional loading boxes for ATMs or TCDs, or in any case in service points in which both the escrow function and the extractable-storage drawer function are performed simultaneously, it is indispensable for it to be inexpensive, light, and resistant to the sort of ill-treatment which it is likely to undergo during transportation.

It is moreover indispensable for the removable portion 450 to be equipped with a shutter and an element for arrest of rotation of the storage plane (said members not being illustrated), in such a way that during transportation it is not possible to remove banknotes from the removable portion 450 or gain access to the inside thereof without perceptibly damaging the container.

FIGS. 14A and 14B illustrate two embodiments of a device according to the present invention, which moreover comprise a singling module 500. These embodiments are typically designed for depositing items in wads, which are singled out by the corresponding singling device and introduced individually into the device, such as, for example, is the case of wads of banknotes deposited in cash-in/cash-out recycling machines.

In the embodiment of FIG. 14A the singling module 500 also performs the function of stacker in the dispensing step.

An example of application of the devices according to this embodiment may be that of machines designed for cash-desks in supermarkets. A certain number of devices inserted in a cabinet are available to the cashier, who, without employing any conveyor device, inserts the denomination of banknote that he or she receives (a single banknote or a number of banknotes in small wads) in the corresponding device and receives the change from one or more devices via the corresponding singling modules 500. Within the machine, the devices can be arranged either vertically or horizontally, or else with a more favourable orientation according to the conformation of the machine in which they are installed.

In the embodiment of FIG. 14B, in addition to the singling module 500, there is also provided a distinct stacker member 510 with a deviator wheel 520. As in the application already described above for cash-desks in supermarkets, the cashier introduces the banknotes manually into each of the devices through the corresponding singling modules 500, but receives the change in the form of banknotes from the devices through the stacker member 510.

It should be emphasized that the deviator wheel 520 is set in rotation always in the same direction (indicated by the arrow 521), thus guaranteeing entry of the banknotes into the device during deposit via the singling module 500 and proper directing to the stacker member 510 during dispensing.

FIG. 15A shows one of the possible configurations of the devices assembled in a machine of the cash-in/cash-out type. In this case, the configuration with four storage/dispensing devices 200 is illustrated, said devices being arranged vertically, as well as a conveyor 240, which develops in a horizontal direction. This configuration gives rise to a machine with horizontal development, which can be easily inserted under a desk since the machine would not be higher than 45-50 cm, including the cabinet. The machine will then be placed, for reasons of ergonomics, at the height from the ground preferred by the user.

This machine is usually interfaced to the cash-desk terminal, so that it is able to carry out all of the required cash-desk functions automatically. The deposits of money are arranged in wads inside the singling device 241, which singles out the banknotes, recognizes their denomination and, if necessary, may be equipped with sensors for verifying their genuineness.

Recognition of the denomination of each banknote singled out determines the positioning of the deviator assemblies 242 in such a way that the banknote will be inserted into the device 200 that corresponds to its denomination. This operation is repeated for each banknote. In the case where two banknotes are picked up at the same time (double" error) the conveyor 240 stops and reverses rotation, bringing out the banknotes that have been singled out and depositing them in the stacker member 243. In the case where the double banknote, or the chain of banknotes, had already been inserted in a device, this will dispense what has been deposited and will bring it back into the conveyor 240 and, consequently, into the stacker member 243. The singling-out process resumes until all the banknotes inserted in the singling module 241 have been used up. The cashier can thus gather any banknotes that may have been rejected from the stacker member 243 and put them back into the singling module 241 in order to attempt to deposit them again.

In the dispensing step, a sum is requested on the cash-desk terminal. Even though frequently also the requested composition of the denominations is also indicated, by default the machine generally dispenses the sum requested using the smallest number of banknotes possible or, in the event of excess or of scarcity of one or more denominations, using a greater number of banknotes of the type in excess and a smaller number of banknotes that are present in low numbers. The path of the banknotes is the one illustrated in the case of error, i.e., from each of the devices 200 to the conveyor 240, until the stacker member 243 is reached.

FIG. 15B is a schematic illustration of the horizontal arrangement of devices 200 according to the present invention in a machine equipped with a conveyor 250 having a vertical development. Obviously, the arrangement of the modules is irrelevant, but it is interesting to note that the various assemblies in FIGS. 15A and 15B give rise to simple machines but ones presenting high levels of performance. This is basically due to the peculiarities of the device according to the present invention.

In the embodiment of FIG. 15B, the conveyor 250 is equipped with wheels 251 having brushes or spokes, which, with their rotation in one direction or the other, enable a banknote to be diverted from the conveyor 250 to any device 200, or else to pass beyond the respective device in order to reach one of the subsequent devices. In the same way, the wheels 251 can divert a banknote exiting from a device 200 in any direction.

This enables a machine with a completely bi-directional conveyor to be obtained and, consequently, a banknote to be directed either towards the dispensing outlet 260 or towards the inlet of another device 200, different from the one from which the banknote was dispensed. This advantageously enables exchange of the position between banknotes from one device 200 to another.

The above peculiarity may appear of little use, but in the actual operating reality many situations may arise, in which this feature enables emergencies to be dealt with, without blocking operation of the machine. For instance, suppose a device 200 dedicated to a denomination that is very much used reaches its maximum capacity (e.g., the 10-Euro note), whilst the module dedicated to 500-Euro banknotes is practically empty (a highly likely situation). The machine keeps having to cash in 10-Euro banknotes. The managing software will block the 500-Euro banknote function and will start sending the 10-Euro banknotes into the module for the 500-Euro banknotes.

Now, suppose that a user asks for a large amount of 500-Euro banknotes. The 10-Euro banknotes deposited in the device assigned to the 500-Euro banknotes prevent dispensing of 500-Euro banknotes. Then the software sends a command for 10-Euro banknotes deposited in the 500-Euro device to be sent out and temporally parks them in another device having sufficient space available, or else in a number of devices. It then dispenses the 500-Euro banknotes requested and subsequently, perhaps during dead times, brings the 10-Euro banknotes back into their original device, if there is sufficient space, or again into the device for the 500-Euro banknotes.

FIG. 16 represents another possible application derived from the combination of a number of devices according to the present invention.

The possibility has already been described of obtaining high-performance machines of a cash-in/cash-out type with the use of this device, and, logically, the best configuration is represented by machines which have available a device for any denomination of banknote handled.

However, both for reasons of space and for reasons of cost, there frequently exist situations in which it is indispensable to be able to handle all the banknote denominations in circulation, but it is not possible to use machines with a lot of modules (e.g., seven banknote denominations in Euro, one or two of which are rarely used but at the same time certainly not altogether absent).

The arrangement illustrated in FIG. 16 offers a possible solution and one that functions efficiently. The banknote 312 is introduced and conveyed in a direction parallel to its longer side. Conveying of the banknote is carried out by an extremely simple conveyor (not represented) until the inlet of two devices set opposite to one another 200 is reached in a position where a deviator (not shown) is present.

At this point, the banknote is stopped and introduced, according to the contents of the two devices 200, into one of the two. In other words, one of the two devices 200, or both of them, contain banknotes in sequence which belong to different denominations. When it is necessary to dispense an amount with (or without) a composition of particular denominations, the banknotes of which the management electronics and/or software know/knows the exact location, are extracted from the devices and dispensed, if they are necessary for making up the amount requested, or else exchanged from one device to another in order to render available for dispensing those banknotes that are present in one of the two devices, but preceded by other banknotes (i.e., ones deposited later) which are not useful for forming the amount required.

FIGS. 17A and 17B show, in a simplified form, a particular arrangement of the devices 200 according to the present invention, in which just one singling module 610 serves alternately one of the devices 200 set within a structure 600, which rotates about its central axis 650. Likewise, just one stacker member 620 is assigned for collecting the banknotes that are dispensed by the various devices 200, one after another.

During the step of deposit of a given banknote denomination (FIG. 17A), to which a given device 200 is assigned, the latter is rotated so as to be displaced into the position corresponding to the singling module 610. Possible subsequent deposits of other banknote denominations will take place via rotation of the structure 600 in order to bring the device 200 concerned into the position corresponding to the singling module 610.

This may come about even automatically in the case where the singling module 610 is equipped with sensors for identifying the banknote denomination or with sensors for banknote validation. In fact, at the moment of singling-out, the banknote that is picked up is identified according to denomination, and the rotating structure 600 brings the corresponding device 200 into the position suitable for receiving it.

The device which is carrying out the depositing step will remain in position until the banknotes that are being singled out prove to belong to one and the same denomination. If the banknote that has been singled out last belongs to another denomination, the mobile structure 600 rotates again to bring the device 200 corresponding to the new banknote denomination into a position corresponding to deposit.

In the dispensing step (FIG. 17B), the structure 600 is rotated so as to cause the device concerned 200, and possibly in succession also other devices 200, to correspond to the dispensing position, namely, the position corresponding to the stacker member 620.

This latter solution, which is apparently less efficient than the ones already described previously, in actual fact has a mode of operation that is quite consistent with the actual situation. For instance, it is unlikely for cashiers in a bank to receive from customers banknotes that are not pre-arranged into wads divided according to denomination. In other words, only in very rare cases are the so-called mixed wads formed in such a way that there can be banknotes of the same denomination that are not consecutive and are mixed up here and there with banknotes of another denomination or other denominations. In other words, in the vast majority of cases the so-called mixed wads are formed in such a way that banknotes of the same denomination are consecutive and not "mixed up" here and there with banknotes of another denomination or other denominations.

Of course, the number of devices 200 can also be other than four as illustrated in FIGS. 17A and 17B.

FIGS. 18A and 18B show a configuration of four devices 200, arranged in two rows and two columns. All four devices may be seen in the front view of FIG. 18A, whilst obviously only two are visible in the side view of FIG. 18B.

Even though it is possible to assemble machines with a number of devices different from the number illustrated, in the case in point, four devices 200 are illustrated, each of which is equipped with a singling module 710 of its own having the dual function of singling module at input and stacker member at output. The configuration here represented could be the same even though the devices were without the corresponding singling device/stacker 710.

Attention is here drawn to the concept of flexibility of the configurations which can be obtained with a device according to the present invention. Basically, the operator has available four or more devices 200 with front access, all of which are contained within an effraction-proof cabinet (not illustrated).

The cashier inserts the wads of banknotes corresponding to a certain denomination in the singling module 710 of the corresponding device. The banknotes singled out and checked are inserted into the corresponding device and then stored. In the case where a banknote of a given denomination is erroneously present in a wad of banknotes of different denomination, the singling-out operation would be arrested in order to allow the cashier to remove any banknote that is wrong.

In the dispensing stage, each of the devices 200 dispenses, in the respective singling device/stacker 710 (which acts in this case as stacker member), the banknotes requested until the amount to be dispensed is made up.

INDUSTRIAL APPLICABILITY

From the foregoing description, it is evident that a device according to the present invention finds innumerable applications. For example, in the case of use as a timed safe, one or more devices are inserted into an appropriate robbery-proof and/or effraction-proof cabinet, presenting to the operator (or to the operators, in the event of sharing of the same machine by a number of operators), one or more mouths for insertion and withdrawal of the money that prevent any banknotes that are entered from being drawn out.

The arrangement of the individual devices may be made as desired by the user (vertical, horizontal, inclined, inserted in a rotating drum, etc., with introduction and withdrawal from above, from the front, from the side, etc.) according to the requirements of space, ergonomics, and functionality. The wads that can be inserted in each device like the one corresponding to the present invention may be hundreds within an extremely contained space if compared to existing machines.

This means that the machine thus derived is a unit with extremely high capacity, if compared to existing equipment. Furthermore, partialization of the money may be quite marked, and the possibility of exploiting a number of options of use (homogeneous or non-homogeneous wads) results in an extreme flexibility of the machine. The device enables, for instance, a very effective timed safe to be obtained, namely a machine that is able to store and dispense mixed wads of banknotes, or wads of banknotes of homogeneous denomination, of pre-defined amount or amounts that may vary from one deposit to another, thus enabling the function of partialization of the overall content of banknotes to be achieved.

In fact, like currently known machines, it affords the possibility of simultaneous use by a number of operators (e.g., the different cashiers of one and the same branch bank), but in addition offers the possibility, in the event of need (e.g., the presence of a false note in a wad deposited) to trace back with complete certainty to which operator was responsible for that particular deposit.

In addition to this, it offers the possibility of dispensing the money in amounts very close to the actual need of each operator, since it enables withdrawal of a wad -of notes or a number of consecutive wads from one or more devices, with delay times in dispensing that are extremely reduced and precisely proportional to the amount requested. The quality of the banknotes introduced and subsequently dispensed does not present any contra-indications as regards the functionality of the device.

A device according to the invention can be contained in boxes and used for storing banknotes and then transported elsewhere and inserted, in the place of the current boxes, into Bankmatic ATMs which would be far simpler and less expensive than the current ones. The device will likewise be able to dispense to a current Bankmatic ATM, without requiring mechanisms for singling-out and without requiring the function of rejection, since they are free from dispensing errors.

Another application of a device and a method according to the present invention is the one already referred to of machines of a cash-in/cash-out recycling type, which can be obtained simply by assembling together a certain number of devices, each equipped with a singling device and a stacker (or with one singling device of the type functioning also as stacker). The operator lays, in the singling device corresponding to the desired banknote denomination, wads of banknotes that are then singled out and introduced into the device one after the other. In the dispensing stage, the amount requested is dispensed by one or more devices simultaneously, according to the requested composition in terms of banknote denominations.

Another application of a device and method according to the present invention is the one already referred to of machines of the cash-in/cash-out recycling type, which can be made simply by assembling together a certain number of devices with a common conveyor, via which it is possible to deposit the banknotes of a homogeneous denomination and/or mixed denominations in the corresponding device, and dispense composite amounts by getting the banknotes due to come out from each device and by conveying them via the common conveyor.

A singling-out member and a stacker can be installed at input to the conveyor. Set downstream of the singling device is a recognition device and, if necessary or requested, also a banknote-validation device. In the singling-out member there can be introduced even mixed wads of banknotes, which are singled out and sent to the corresponding storage device after each banknote has been recognized in terms of currency, denomination, and validity.

In the event of a singling error, the machine which uses a device according to the present invention has no need of a rejection function in so far as, once the depositing operation is terminated, it is simple to extract from the device the wrong deposit and return it to the operator for him to re-introduce it into the singling device. This technology moreover enables assemblage of machines having different shapes and dimensions, since it is possible for the new device to operate indifferently in a horizontal position, a vertical position and/or in a position inclined in any direction.

It should be emphasized that the device and the method according to the present invention enable storage of instruments of credit in the form of wads. In the case in point, these are banknotes which may be inserted sequentially in wads, which are homogeneous as regards banknote denomination and have the same total amount or different total amounts, or else may be inserted sequentially also in wads of mixed banknote denomination, which have the same total amount or different total amounts.

There should moreover be emphasized the possibility of application of the principles of the present invention in machines for storing and dispensing envelopes containing different instruments of credit and coins in the form of change, machines equipped with readers for verifying the genuineness, denomination, and currency, for rendering services of receipts of payment, and machines equipped with banknote-accepting devices, in which one or more devices according to the invention perform the function of escrow, currency-exchange machines, or machines for changing coins into banknotes and vice versa.

Even though all the embodiments illustrated herein refer to the specific case of storing and/or dispensing banknotes, or wads of banknotes, it is to be emphasized that the method and the device according to the present invention find application in general also for handling other rigid or flexible planar items.

This proves particularly advantageous as compared to known devices of the roller type, with which it is not possible to handle items that are substantially rigid, such as telephone cards, membership cards, or the like.

In fact, in addition to the machines for storing and/or dispensing banknotes, a device according to the invention advantageously finds application also in many other types of machines and equipment that it is possible to imagine can benefit from the peculiarities of the present method and type of device, bearing in mind that the device according to the present invention is not affected by the fact that the media to be handled are rigid, semi-rigid or flexible, like the material of which they are made.

Furthermore, the device does not subject the items handled to any folding or bending, is unaffected by their thickness and variations in thickness between one medium and the next, and does not damage the media handled; instead, the storage method can even improve the state of conservation thereof. Furthermore, thanks to the device and method of the present invention, it is always possible to know with certainty the correspondence between the position of each item deposited and who or what has made the deposit, or what amount has been deposited and when.

In general, the device and method according to the present invention can find advantageous application for storage and dispensing of various substantially planar items, for example materials in the form of sheets, whether entire of folded, items inserted in rigid or flexible envelopes, flexible or rigid envelopes themselves, badges, identity cards, tickets, credit cards, paper securities, cheques, coins in envelopes, cards inserted in envelopes and the like, and moreover in any state of wear.

A device according to the invention finds advantageous application also in machines for insertion and withdrawal of identity cards and similar documents that have not yet been personalized. The use of a device according to the present invention enables dispensing exclusively of the number of documents necessary for the customer making the request, linking each dispensing operation to the operator making the withdrawal. This is achieved simply by associating each dispensing operation to a personal recognition code of the operator, such as a simple password, an access badge, a transponder, a Dallas key, or the like.

A device according to the invention is moreover suitable for production of specific machines for storing and dispensing telephone cards, also ones pre-inserted in envelopes, i.e. self-service machines such as the so-called "vending machines".

A further specific application may be that of machines capable of storing documents, such as identity cards, passports, driving licences, etc., which still have to be personalized, and dispensing said documents only in the amount required and exclusively by operators who are responsible for their personalization, thus preventing any possible theft of the documents themselves.

Yet a further application is for machines that are able to store and dispense ski-pass cards, motorway-toll cards, railway tickets or tickets for other public means of transport etc., theatre tickets, cinema tickets, tickets for entrance to football grounds, etc., parking tickets and/or cards, or any other type of instruments of credit in self-service points, or manned service points.

Furthermore, it is possible also to build machines for storing and dispensing road maps, and even folded maps at the entrance to towns or particular sites, such as museums, etc.

The invention claimed is:

1. A device for storing and/or dispensing, one by one or either in homogeneous or non homogeneous bundles, substantially planar items in the form of rigid or flexible sheets, comprising at least one supporting element driven in rotation by at least one electric motor and a ribbon wound on said supporting element and on at least one take-up member for taking up said ribbon, the planar items being stored sequentially between successive windings of said ribbon that are wound and unwound between said supporting element and said at least one take-up member, wherein said supporting element is made of a rigid material and has a non-circular cross section for obtaining one or more distinct rigid resting surfaces, on which said planar items rest and said ribbon is wound.

2. The device according to claim 1, wherein said supporting element comprises one or more convex resting surfaces.

3. The device according to claim 1, wherein said supporting element compnses one or more concave resting surfaces.

4. The device, according to claim 1, wherein said supporting element comprises one or more planar resting surfaces.

5. The device according to claim 1, wherein said supporting element comprises at least two resting surfaces, on which said ribbon is wound.

6. The device according to claim 1, wherein each of said planar items is stored, either totally or in part, on each of said one or more resting surfaces.

7. The device according to claim 1, wherein said one or more resting surfaces of said supporting element have a quadrangular shape in plan view.

8. The device according to claim 7, wherein the axis of rotation of said supporting element is substantially parallel to at least one of the sides of said quadrangular surface.

9. The device according to claim 1, wherein said supporting element is formed by a plate having a substantially rectangular shape in plan view and comprising at least two of said opposed resting surfaces.

10. The device according to claim 9, wherein said supporting element is set in rotation about an axis coinciding with one of the axes of symmetry of said plate.

11. The device according to claim 9, wherein said substantially rectangular plate has a larger side of dimension equal to or greater than the larger dimension of said planar items in plan view and a smaller side of dimension equal to or greater than the smaller dimension of said planar items in plan view.

12. The device according to claim 1, wherein said ribbon comprises at least one film wound in part on said supporting element and in part on at least one take-up member.

13. The device according to claim 12, wherein at least one of said films has at least one of its surfaces rough, coarse, irregular or in any case non-smooth.

14. The device according to claim 12, wherein at least one of said films is embossed.

15. The device according to claim 12, wherein at least one of said films has at least one surface, on which there is deposited, either totally or in part, a layer of material with properties of adherence.

16. The device according to claim 12, wherein said take-up members are constituted by cylindrical rollers.

17. The device according to claim 12, wherein said take-up members are constituted by rollers with polygonal cross section.

18. The device according to claim 1, wherein said ribbon comprises at least two distinct films wound in part on said supporting element and in part on at least two corresponding distinct take-up members, the planar items being stored sequentially between said two distinct films.

19. The device according to claim 18, wherein said at least two take-up members are driven in rotation by distinct electric motors. members are constituted by rollers with polygonal cross section.

20. The device according to claim 18, wherein said at least two take-up members are driven in rotation by a single motor.

21. The device according to claim 1, further comprising a controller to control the traction of said ribbon between said supporting element and said at least one take-up member.

22. The device according to claim 21, wherein said controller comprises at least one dandy-roller system.

23. The device according to claim 21, wherein said controller includes one or more braking systems that can be operated upon command.

24. The device according to claim 21, wherein said controller includes one or more braking systems with pre-defined friction.

25. The device according to claim 21, wherein said controller includes a drive to drive in rotation in just one direction, mounted on the shafts of said take-up members.

26. The device according to claim 1, further comprising one or more optical sensors to detect the angular position of said supporting element.

27. The device according to claim 1, wherein said device is formed by at least two distinct portions that can be separated from one another.

28. The device according to claim 27, wherein said device includes at least one first portion containing at least the motor for actuation in rotation of said supporting element and at least one or more motors for actuation in rotation of one or more take- up members of said ribbon, as well as at least one second portion containing at least said supporting element and said one or more take-up members.

29. The device according to claim 28, wherein there are provided gear drive means set between said motors contained in said first portion and the elements driven in rotation contained in said second portion.

30. A machine for storing and/or dispensing substantially planar items in the form of rigid or flexible sheets, comprising one or more storing and/or dispensing devices according to claim 1.

31. A method for storing and/or dispensing, one by one or either in homogeneous or non homogeneous bundles, substantially planar items in the form of rigid or flexible sheets, including:

storing sequentially said planar items between successive windings of a ribbon which is wound on a supporting element driven in rotation by at least one electric motor and unwound from at least one take-up member, dispensing sequentially said planar items previously stored by unwinding said ribbon from said supporting element and winding the ribbon on at least one take-up member, forming said supporting element in a non-circular cross section made of rigid material for obtaining one or more distinct rigid resting surfaces, on which said planar items rest and said ribbon is wound.

32. The method according to claim 31, wherein said planar items are stored on a supporting element comprising one or more convex resting surfaces.

33. The method according to claim 31, wherein said planar items are stored on a supporting element comprising one or more concave resting surfaces.

34. The method according to claim 31, wherein said planar items are stored on a supporting element comprising one or more planar resting surfaces.

35. The method according to claim 31, wherein said ribbon is wound on a supporting element comprising at least two resting surfaces.

36. The method according to claim 31, wherein each of said planar items is stored, either totally or in part, on each of said one or more resting surfaces.

37. The method according to claim 31, further comprising forming said resting surfaces to have a substantially quadrangular shape in plan view, and setting said supporting element in rotation about an axis which is substantially parallel to at least one of the sides of said quadrangular plane surfaces.

38. The method according to claim 31, further comprising forming said supporting element by a plate having a substantially rectangular shape in plan view, comprising at least two of said opposed resting surfaces.

39. The method according to claim 38, wherein said supporting element is set in rotation about an axis coinciding with one of the axes of symmetry of said plate.

40. The method according to claim 38, wherein said substantially rectangular plate has a larger side of dimension equal to or greater than that of the larger side of said planar items and a smaller side of dimension equal to or greater than that of the smaller side of said planar items.

41. The method according to claim 31, wherein said ribbon comprises at least one film wound in part on said supporting element and in part on said at least one take-up member.

42. The method according to claim 41, further comprising forming at least one of said films to have at least one of its surfaces rough, coarse, irregular or in any case non-smooth.

43. The method according to claim 41, wherein at least one of said films is embossed.

44. The method according to claim 41, wherein at least one of said films has at least one surface on which there is deposited, either totally or in part, a layer of material with properties of adherence.

45. The method according to claim 41, wherein said take-up members are constituted by cylindrical rollers.

46. The method according to claim 41, wherein said take-up members are constituted by rollers with polygonal cross section.

47. The method according to claim 31, wherein said ribbon comprises at least two distinct films wound in part on said supporting element and in part on at least two corresponding distinct take-up members, the planar items being stored sequentially between said two distinct films.

48. The method according to claim 47, wherein said at least two take-up members are driven in rotation by distinct electric motors.

49. The method according to claim 47, wherein said at least two take-up members are driven in rotation by a single motor.

50. The method according to claim 31, further comprising controlling traction of said ribbon between said supporting element and said at least one take-up member.

51. The method according to claim 50, wherein said controlling of traction is performed by at least one dandy-roller system.

52. The method according to claim 50, wherein said -controlling of traction is performed by one or more braking systems that can be operated upon-command.

53. The method according to claim 50, wherein said -controlling of traction is performed by one or more braking systems with pre-defined friction.

54. The method according to claim 50, wherein said -controlling of traction is performed by means for driving in rotation in just one direction, mounted on the shafts of said take-up members.

55. The method according to claim 31, further comprising detecting the angular position of said supporting element.

56. The method according to claim 31, wherein said planar items are carried in a position corresponding to said ribbon and/or said at least one plane surface of said supporting element along a path that is substantially parallel to the direction of movement of said ribbon.

57. The method according to claim 31, wherein said planar items are carried in a position corresponding to said ribbon and/or said at least one plane surface of said supporting element along a path substantially perpendicular to the direction of movement of said ribbon.

58. A device for storing and/or dispensing substantially planar items in the form of rigid or flexible sheets, comprising at least one supporting element to be driven in rotation by at least one electric motor and a ribbon to be wound on said supporting element and on at least one take-up member for taking up said ribbon, the planar items being stored sequentially between successive windings of said ribbon that are wound and unwound between said supporting element and said at least one take-up member, wherein said supporting element has a non-circular cross section to define one or more distinct resting surfaces, on which said ribbon is wound, and wherein the device further comprises one or more optical sensors to detect the angular position of the supporting element.

59. A method for storing and/or dispensing substantially planar items in the form of rigid or flexible sheets, including:

storing sequentially said planar items between successive windings of ribbon which are wound on a supporting element driven in rotation by at least one electric motor and unwound from at least one take-up member;

dispensing sequentially said planar items previously stored by unwinding said ribbon from said supporting element and winding them on at least one take-up member;

forming said supporting element to have a non-circular cross section to define one or more distinct resting surfaces, on which said ribbon is wound; and detecting the angular position of the supporting element.

* * * * *